US011098261B2

(12) United States Patent
Wang et al.

(10) Patent No.: US 11,098,261 B2
(45) Date of Patent: Aug. 24, 2021

(54) LUBRICANT INFUSED SURFACES

(71) Applicant: Massachusetts Institute of Technology, Cambridge, MA (US)

(72) Inventors: Evelyn N. Wang, Cambridge, MA (US); Daniel John Preston, Cambridge, MA (US)

(73) Assignee: MASSACHUSETTS INSTITUTE OF TECHNOLOGY, Cambridge, MA (US)

( * ) Notice: Subject to any disclaimer, the term of this patent is extended or adjusted under 35 U.S.C. 154(b) by 0 days.

(21) Appl. No.: 16/194,262

(22) Filed: Nov. 16, 2018

(65) Prior Publication Data

US 2020/0024539 A1 Jan. 23, 2020

Related U.S. Application Data

(60) Provisional application No. 62/587,447, filed on Nov. 16, 2017.

(51) Int. Cl.

| | |
|---|---|
| ***C10M 105/80*** | (2006.01) |
| ***C10M 171/00*** | (2006.01) |
| ***B08B 17/06*** | (2006.01) |
| ***C10N 20/00*** | (2006.01) |
| ***C10N 50/02*** | (2006.01) |
| ***C10N 50/08*** | (2006.01) |

(52) U.S. Cl.

CPC ..... *C10M 105/80* (2013.01); *C10M 171/00* (2013.01); *B08B 17/065* (2013.01); *C10M 2227/04* (2013.01); *C10M 2227/045* (2013.01); *C10N 2020/093* (2020.05); *C10N 2050/02* (2013.01); *C10N 2050/08* (2013.01)

(58) Field of Classification Search

CPC ..... C10M 105/80; C10M 171/00; C10M 2201/06; C10M 2201/062; C10M 2227/04; C10M 2227/045; C10N 2220/082; C10N 2220/144; C10N 2250/04; C10N 2250/08; C10N 2250/121; C10N 2020/055; C10N 2020/06; C10N 2020/093; C10N 2050/02; C10N 2050/04; C10N 2050/06; C10N 2050/08; B08B 17/065

See application file for complete search history.

(56) References Cited

U.S. PATENT DOCUMENTS

2013/0032316 A1* 2/2013 Dhiman ..... B64D 15/06 165/133

OTHER PUBLICATIONS

Sun, C.-C., Lee, S.-C., Hwang, W.-C., Hwang, J-S., Tang, I-T., Fu, Y.-S., "Surface Free Energy of Alloy Nitride Coatings Deposited Using Closed Field Unbalanced Magnetron Sputter Ion Plating", Materials Transasctions, 2006, 47(10), 2533-2539 (Year: 2006).*

* cited by examiner

*Primary Examiner* — James C Goloboy
(74) *Attorney, Agent, or Firm* — Honigman LLP

(57) ABSTRACT

Lubricant infused surfaces (LIS) can be uncoated high-surface-energy solids, thereby eliminating the need for unreliable low-surface-energy coatings and resulting in LIS repelling the lowest surface tension impinging fluid (butane, $\gamma \approx 13$ mN/m) reported to date.

13 Claims, 10 Drawing Sheets

LUBRICANT INFUSED SURFACES

CLAIM OF PRIORITY

This application claims priority to U.S. Provisional Patent Application No. 62/587,447, filed Nov. 16, 2017, which is incorporated by reference in its entirety.

STATEMENT REGARDING FEDERALLY SPONSORED RESEARCH OR DEVELOPMENT

This invention was made with Government support under Grant No. N00014-12-1-0624 awarded by the Office of Naval Research. The Government has certain rights in the invention.

TECHNICAL FIELD

This invention relates to lubricant infused surfaces.

BACKGROUND

Lubricant infused surfaces (LIS) have risen to prominence in micro- and nanoscale research, fluid dynamics, heat transfer, biology, and lab-on-a-chip due to their impressive ability to shed impinging droplets. LIS comprise a textured solid surface into which a lubricant is "infused," or spontaneously wicked, and on which an impinging fluid ideally forms discrete droplets which easily shed from the surface. Conceived in 1959 and explored briefly in subsequent work, the significance of LIS has only more recently been recognized through developments reported independently by LaFuma and Quere and Wong et al. in 2011. Since then, applications have spanned from condensation enhancement, to anti-icing, and even paper-based microfluidics. See, for example, References 1-16.

SUMMARY

Lubricant infused surfaces (LIS) can be uncoated high-surface-energy solids, thereby eliminating the need for unreliable low-surface-energy coatings and resulting in LIS repelling the lowest surface tension impinging fluid (butane, $\gamma \approx 13$ mN/m) reported to date. The method described herein includes the selection of a suitable lubricant based on the surface energy criteria described below such that the lubricant has an affinity towards a high-surface-energy structured solid, eliminating the need for the low-surface-energy coating applied to the solid that has been relied on in prior work.

In one embodiment, a method of preparing a lubricant infused surface for droplet formation can include providing a surface, selecting a lubricant suitable for the surface based on surface energy criteria that the lubricant has an affinity towards the surface, and exposing the surface to the selected lubricant to form the lubricant infused surface. The surface can directly contact the lubricant without the presence of coating on the surface.

In another embodiment, the method of droplet formation can include exposing a lubricant infused surface to a vapor, the lubricant infused surface being selected as suitable for the surface based on surface energy criteria that the lubricant has an affinity towards the surface.

In another embodiment, a lubricant infused surface can include a surface and a lubricant infused into the surface, the surface being selected based on surface energy criteria that the lubricant has an affinity towards the surface. In certain circumstances, the surface can directly contact the lubricant.

In certain circumstances, the surface can be a high-surface-energy structured solid.

In certain circumstances, the surface can be exposed to the selected lubricant to form the lubricant infused surface without applying a low-surface-energy coating the surface.

In certain circumstances, the lubricant infused surface can form droplets of an impinging fluid with finite wetting angle even when the impinging fluid has a surface energy lower than a surface energy of the surface.

In certain circumstances, the lubricant and a portion of the surface can have polar affinity.

In certain circumstances, the surface energy criteria leads to the lubricant can be selected to have a surface energy of the lubricant that does not match a surface energy of the surface.

In certain circumstances, the lubricant infused surface can repel extremely low-surface-tension fluids (e.g., fluids with a surface tension of less than 15 mN/m).

Other aspects, embodiments, and features will be apparent from the following description, the drawings, and the claims.

DETAILED DESCRIPTION

Figure 1:
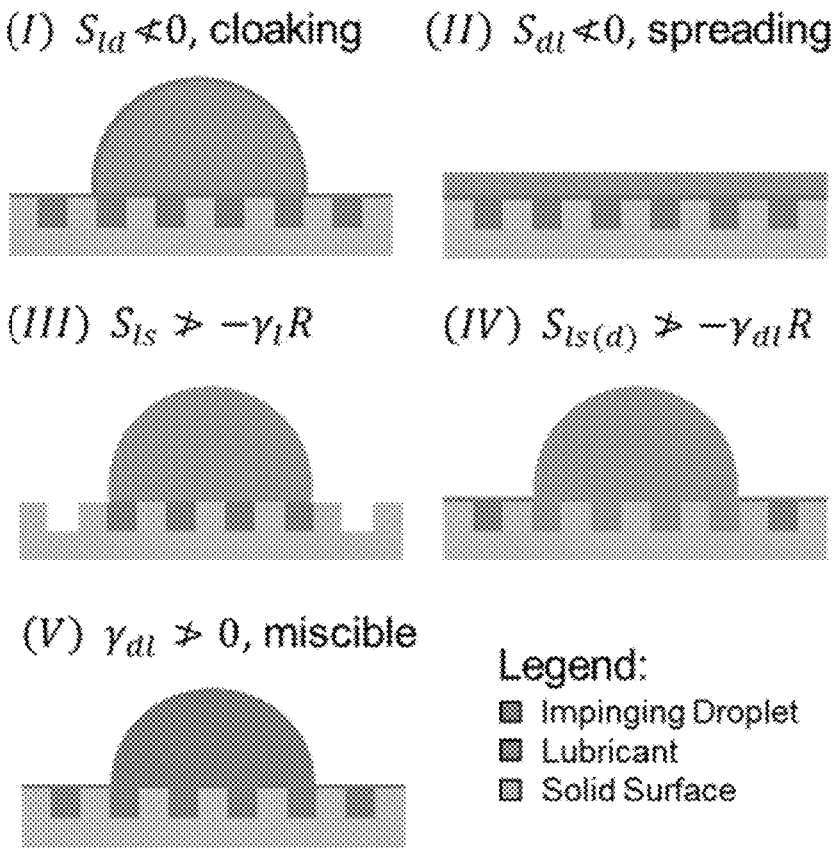
FIG. 1 depicts failure modes predicted from surface-energy-based criteria for LIS design. The ideal droplet of impinging fluid on a LIS rests atop a combined lubricant-solid layer. If criterion (I) is not satisfied, the droplet will be "cloaked," or covered with a thin layer of lubricant, which may eventually deplete the surface of lubricant as droplets depart. The impinging fluid will spread over the LIS as a film if criterion (II) is not met. Criteria (III) and (IV) must be met to ensure that the lubricant remains infused in the rough solid. If $S_{ls(v)}$ or $S_{ls(d)}$ are greater than zero, the lubricant will cover the entire surface in the presence of the vapor or condensate, respectively; otherwise, if (III) or (IV) are still satisfied but $S_{ls}$ or $S_{ls(d)}$ are less than zero, a fraction $\varphi$ of the solid will contact the impinging fluid in the presence of the vapor or condensate, respectively. Miscibility of the impinging fluid and the lubricant is characterized by the interfacial tension between these two fluids, where if criterion (V) is not met, it is energetically favorable for the two fluids to form an infinitely large interface (i.e., fully mix).

Lubricant infused surfaces (LIS) are a recently-developed and promising approach to fluid repellency for applications in biology, microfluidics, thermal management, lab-on-a-chip, and beyond. The design of LIS has been explored in past work in terms of surface energies which need to be determined empirically for each interface in a given system. Here, an approach was developed which predicts a priori whether an arbitrary combination of solid and lubricant will repel a given impinging fluid. This model was validated with experiments performed in our work as well as in literature and was subsequently used to develop a new framework for LIS with distinct design guidelines. Furthermore, insights gained from the model led to the experimental demonstration of LIS using uncoated high-surface-energy solids, thereby eliminating the need for unreliable low-surface-energy coatings and resulting in LIS repelling the lowest surface tension impinging fluid (butane, $\gamma \approx 13$ mN/m) reported to date.

A method of preparing a lubricant infused surface for droplet formation can include providing a surface, selecting a lubricant suitable for the surface based on surface energy criteria that the lubricant has an affinity towards the surface, and exposing the surface to the selected lubricant to form the lubricant infused surface. The surface can directly contact the lubricant without the presence of coating on the surface. In other words, the LIS structures of the invention can be designed to create the conditions shown in FIG. 1 without a coating the surface of a substrate with a material having a lower energy than the energy of the surface.

In these conditions, a method of droplet formation can include exposing a lubricant infused surface to a vapor, the lubricant infused surface being selected as suitable for the surface based on surface energy criteria that the lubricant has an affinity towards the surface.

A lubricant infused surface can include a surface and a lubricant infused into the surface, the surface being selected based on surface energy criteria that the lubricant has an affinity towards the surface. In certain circumstances, the surface can directly contact the lubricant.

The surface can be a high-surface-energy structured solid, for example, a solid surface with a roughness that creates a high-surface energy relative to a smooth surface of the same material. In certain circumstances, the surface can be exposed to the selected lubricant to form the lubricant infused surface without applying a coating the surface that can lower the surface-energy of the substrate. When the condition of a LIS is accomplished, the lubricant infused surface can form droplets of an impinging fluid with finite wetting angle even when the impinging fluid has a surface energy lower than a surface energy of the surface.

The lubricant and a portion of the surface can be designed to have polar affinity or nonpolar affinity. The surface energy criteria can lead to the lubricant can be selected to have a surface energy of the lubricant that does not match a surface energy of the surface. For example, the lubricant infused surface can repel extremely low-surface-tension fluids (e.g., fluids with a surface tension of less than 15 mN/m).

Suitable substrates and liquids that can be combined and evaluated according to the model described below are exemplified in Tables 1, 2 and 3.

LIS have also been shown to exhibit the ability to repel low surface tension fluids (as low as 17 mN/m), (Reference 11 and 17), which is critical for applications in thermal management and hydrocarbon processing.

A low-surface-energy coating is a coating applied to a solid that lowers the apparent surface energy of the solid. A high-surface-energy is a surface energy too high to achieve the desired fluid wetting behaviour. A high-surface-energy solid can be a solid surface energy high enough to result in an undesirably low fluid contact angle of an impinging fluid on the solid or complete wetting of the solid surface by the impinging fluid.

For example, several fluids like water (72 mN/m) and glycerol (64 mN/m) can be considered to have a high surface tension, while fluids like refrigerants (e.g. r245 fa, 14 mN/m) and hydrocarbons (e.g. toluene, 28 mN/m) can be considered to have a low surface tension. Similarly, solids like silicon dioxide (59 mN/m) and silicon (62 mN/m) are high-surface-energy, while plastics like teflon (20 mN/m) and polypropylene (32 mN/m) are low-surface-energy. Note that mN/m is the typical unit of surface tension, for liquids, or surface energy, for solids; these two terms are essentially interchangeable. With these "R" values in mind, the cutoff between low- and high-surface-energy materials can be about 45 mN/m, for example, between 35 to 55 mN/m. Low-surface-energy materials are more often nonpolar, and high-surface-energy materials are more often polar, although there are exceptions.

A structured solid is a solid that has some geometric feature or features such that it is not flat. The structured solid has a surface that can have nanometer or micrometer scale features. For example, in the context of lubricant infused surfaces, the structure surface can have a higher geometric factor "R", which corresponds to a rougher surface.

The design of these surfaces, specifically the choice of a rough solid and a lubricant for a given impinging fluid based on energetic considerations, is well-understood. (References 10-11 and 18). LIS need to meet the following criteria: the impinging fluid must be immiscible with the lubricant; the lubricant must wet the solid structures both with and without the impinging fluid present; and the impinging fluid must form discrete droplets on the LIS as opposed to a continuous film. Based on this understanding, all of the works on LIS design have presented models which require either contact angles or spreading coefficients of the impinging fluid and lubricant on the solid surface, as well as the interfacial tension between the lubricant and the impinging fluid. Unfortunately, these properties have been measured empirically and used to justify LIS behavior after experiments with LIS were already conducted. Predictive capability has not been possible for combinations of fluids and solids where empirical knowledge of all of the interfacial energies in the system is not readily available.

Here, an approach to determine a priori whether an arbitrary combination of solid and lubricant will repel a given impinging fluid is presented. This model predicts the unknown surface energies in the system based on the method proposed by van Oss, Chaudhury, and Good (vOCG). See, Reference 19. This model was validated against experiments performed in the present work as well as the literature, through which was shown to have excellent predictive capability. With this framework for LIS design, it is shown that LIS on uncoated high-surface-energy solids are possible, thereby eliminating the need for unreliable (Reference 20) low-surface-energy coatings typically used. Furthermore, repulsion of the lowest surface tension impinging fluid (butane, $\gamma \approx 13$ mN/m) reported using a LIS is experimentally demonstrated, which in this case included an uncoated high-surface-energy solid (silicon dioxide) with a fluorinated but highly polar lubricant (hexafluoroisopropanol).

Predictive LIS Model

LIS behavior is governed by the interfacial interactions between the three condensed phases (solid, lubricant, and impinging fluid, with each other and with the surrounding environment) and by the geometry of the solid surface. These interfacial interactions and surface geometry can be used to predict whether a LIS will successfully repel an impinging fluid as discrete droplets. The geometry of the solid surface is described by the roughness, r, which represents the actual solid surface area divided by the projected area, and the solid fraction, $\varphi$, which represents the fraction of the solid which contacts the base of an impinging droplet; these properties are combined here as the geometric factor $R=(r-1)/(r-\varphi)$, where R can vary from 0 for a flat surface to 1 for an extremely rough surface. Meanwhile, the interfacial interactions can be described at a high level by the surface energies of the three phases with the surrounding vapor and either the contact angles or the spreading parameters of the three phases with each other.

The criteria which must be met for a functional LIS can be considered in terms of the spreading parameters $S_{xy}$ for each interface in the system, where the first and second subscript of $S_{xy}$ refer to the spreading phase and the reference phase, respectively. If the total energy required for the reference phase to be covered by a layer of the spreading phase is negative, indicating spontaneous coverage of the reference phase by the spreading phase, the spreading parameter is positive. Accordingly, the spreading parameter is defined as $S_{xy}=\gamma_y-(\gamma_{xy}+\gamma_x)$, where $\gamma_x$ and $\gamma_y$ are the surface energies of phases x and y with the surroundings and $\gamma_{xy}$ is the interfacial energy between phases x and y. In the following discussion regarding LIS, the subscript l refers to the lubricant, d the impinging fluid droplet, and s the solid. When a single symbol appears in the subscript, it refers to the interface of that phase with its own vapor. Two symbols appearing in the same subscript indicates an interface between two phases, with the symbols referring to the two phases; in the case of the spreading coefficient, the first symbol is the spreading phase and the second symbol is the reference phase.

In the ideal case, the impinging fluid forms a discrete droplet on the LIS and the lubricant remains trapped within the rough solid structured surface beneath the droplet. If criterion (I), $$S_{ld}<0 \tag{1}$$

is not met and the spreading parameter for the lubricant on the droplet is positive, the lubricant spontaneously spreads over and "cloaks" the droplet as shown in FIG. 1. The cloaked droplet retains most of the functionality of a non-cloaked droplet on the LIS (high mobility, etc.), but the cloaked state is still generally undesirable due to the removal of lubricant when droplets depart from the surface, depleting the lubricant over time. If criterion (II), $$S_{dl}<0 \tag{2}$$

is not met, the impinging fluid spreads indefinitely over the lubricant, resulting in formation of a film instead of discrete droplets and subsequent failure of the LIS. If criteria (III) and (IV), $$S_{ls}>-\gamma_l R \tag{3}$$

$$S_{ls(d)}>-\gamma_{dl} R \tag{4}$$

are not met, the lubricant does not spread within the rough structured solid surface during operation (the subscript (d) in criterion (IV) means "in the presence of the impinging droplet"). Specifically, when criterion (III) is not met, the lubricant does not infuse in the solid structures in the presence of the surrounding vapor, and when criterion (IV) is not met, the lubricant does not infuse in the solid structures in the presence of the impinging fluid, either of which results in failure of the LIS. If the spreading coefficients $S_{ls}$ and $S_{ls(d)}$ in the inequalities in criteria (III) or (IV) exceed zero, the lubricant fully covers the solid surface in the presence of the vapor or the impinging fluid, respectively, as opposed to leaving the tops of the rough solid structures exposed. The case where the structures are completely covered by lubricant results in significantly reduced contact angle hysteresis, as described in detail in past work, but is not necessary for a stable LIS. See Reference 18. Finally, if condition (V), $$\gamma_{dl}>0 \tag{5}$$

is not met, the interface between the lubricant and the impinging fluid increases its surface area indefinitely to minimize energy, ultimately resulting in the miscibility of the two fluids—criterion (V) has not been expressed quantitatively in previous literature on LIS.

The interfacial energies between any two condensed phases in these criteria, namely $\gamma_{dl}$, $\gamma_{ls}$, and $\gamma_{ds}$, are not typically tabulated for the majority of interfacial interactions of interest and therefore have only been obtained experimentally for the phases considered in prior work on LIS. Here, the above energy-based criteria are unified with a model that can predict the unknown interfacial energies in order to gain new insight into LIS surface design and additionally reduce the time required to experimentally characterize a given combination of N materials from $O(N^3)$ to $O(N^3)$; for example, this method results in a reduction in the number of required experiments by two orders of magnitude when considering combinations of 30 impinging fluids, lubricants, and solids (see Supporting Information below). One starts with Fowkes' assumption that an interfacial energy can be divided into contributions from various intermolecular forces, e.g., dispersive, polar, metallic, etc., and then predict these components independently from properties of the interacting phases. See References 21-22. The dispersive (or London) forces are combined with induced dipole and permanent dipole forces and termed the Lifshitz-van der Waals (LW) component of interfacial energy, which can be determined based on physical first principles with reasonable confidence from a geometric combining rule. See References 21-22. The polar component was initially treated in the same manner by Owens and Wendt (OW), (see Reference 23) but this method is now considered obsolete and has been largely replaced by the more accurate method proposed by van Oss, Chaudhury, and Good (vOCG) (see References 19 and 24-26) in which Lewis acid-base contributions to interfacial energy are considered. The vOCG method outperforms the OW method most notably in cases were hydrogen bonding is involved, and is also considered more versatile than the commonly-used Neumann method (see Reference 27); as such, the vOCG method is used here to predict the polar contribution to interfacial energy between condensed phases. See References 26-28. Metallic interactions are not considered here, but would need to be considered to account for interactions between phases such as mercury and metallic solids.

For any given phase (1), the total interfacial energy is found from the LW and acid-base components as shown in Equation 6, where the geometric mean of the vOCG acid-base terms yields the polar interaction (acid term represented by superscript +, base represented by superscript −). The interfacial tension between two phases (1 & 2) is found from Equation 7, where each fluid's LW and acid-base terms are considered. Note that when phases 1 and 2 have identical LW and acid-base terms (i.e., they are the same fluid) the interfacial energy recovered from Equation 7 is zero as expected.

$$\gamma_1^{total}=\gamma_1^{LW}+2\sqrt{\gamma_1^{+}\gamma_1^{-}} \tag{6}$$

$$\gamma_{12}^{total}=\gamma_1^{LW}+\gamma_2^{LW}-2\sqrt{\gamma_1^{LW}\gamma_2^{LW}}+2\sqrt{\gamma_1^{+}\gamma_1^{-}}+2\sqrt{\gamma_2^{+}\gamma_2^{-}}-2\sqrt{\gamma_1^{+}\gamma_2^{-}}-2\sqrt{\gamma_2^{+}\gamma_1^{-}} \tag{7}$$

Model Description

LIS behavior is governed by the interfacial interactions between the three condensed phases (solid, lubricant, and impinging fluid, with each other and with the surrounding environment) and by the geometry of the solid surface. These interfacial interactions and surface geometry can be used to predict whether a LIS will successfully repel an impinging fluid as discrete droplets. The geometry of the solid surface is described by the roughness, r, which represents the actual solid surface area divided by the projected area, and the solid fraction, q, which represents the fraction of the solid which contacts the base of an impinging droplet; these properties are combined here as the geometric factor $R=(r-1)/(r-\varphi)$, where R can vary from 0 for a flat surface to 1 for an extremely rough surface. In the results presented above, $r=5$ and $\varphi=0.04$.

Meanwhile, the interfacial interactions can be described at a high level by the surface energies of the three phases with the surrounding vapor and either the contact angles or the spreading parameters of the three phases with each other. The criteria which must be met for a functional LIS can be considered in terms of the spreading parameters S, for each interface in the system, where the first and second subscript of S, refer to the spreading phase and the reference phase, respectively. If the total energy required for the reference phase to be covered by a layer of the spreading phase is negative, indicating spontaneous coverage of the reference phase by the spreading phase, the spreading parameter is positive. Accordingly, the spreading parameter is defined as $S_{xy}=\gamma_y-(\gamma_{xy}+\gamma_x)$, where $\gamma_x$ and $\gamma_y$ are the surface energies of phases x and y with the surroundings and $\gamma_{xy}$ is the interfacial energy between phases x and y. In the following discussion regarding LIS, the subscript l refers to the lubricant, d the impinging fluid droplet, and s the solid. When a single symbol appears in the subscript, it refers to the interface of that phase with its own vapor. Two symbols appearing in the same subscript indicates an interface between two phases, with the symbols referring to the two phases; in the case of the spreading coefficient, the first symbol is the spreading phase and the second symbol is the reference phase. The four relevant spreading parameter constraints that must be satisfied, as well as one surface tension constraint to prevent miscibility of the impinging fluid and the lubricant, are detailed in FIG. 1 and Equations 8-12 below.

Equation 7 is used to predict the three interfacial energies between condensed phases, $\gamma_{dl}$, $\gamma_{ls}$, and $\gamma_{ds}$, used in criteria (I) to (V) shown in FIG. 1. The ideal droplet of impinging fluid on a LIS rests atop a combined lubricant-solid layer. If criterion (I) is not satisfied, the droplet will be "cloaked," or covered with a thin layer of lubricant, which may eventually deplete the surface of lubricant as droplets depart. The impinging fluid will spread over the LIS as a film if criterion (II) is not met. Criteria (III) and (IV) must be met to ensure that the lubricant remains infused in the rough solid. If $S_{ls(v)}$ or $S_{ls(d)}$ are greater than zero, the lubricant will cover the entire surface in the presence of the vapor or condensate, respectively; otherwise, if (III) or (IV) are still satisfied but $S_{ls}$ or $S_{ls(d)}$ are less than zero, a fraction p of the solid will contact the impinging fluid in the presence of the vapor or condensate, respectively. Miscibility of the impinging fluid and the lubricant is characterized by the interfacial tension between these two fluids, where if criterion (V) is not met, it is energetically favorable for the two fluids to form an infinitely large interface (i.e., fully mix). The expanded forms of criteria (I) to (V), substituting Equations 6 and 7 into Equations 1 through 5, are presented in Equations 8 through 12, respectively:

$$\text{Criterion } (I)\text{: } S_{ld} = \gamma_d - (\gamma_{dl} + \gamma_l) = \gamma_d^{LW} + 2\sqrt{\gamma_d^+\gamma_d^-} - \gamma_l^{LW} - 2\sqrt{\gamma_l^+\gamma_l^-} - \gamma_d^{LW} - \gamma_l^{LW} + 2\sqrt{\gamma_d^{LW}\gamma_l^{LW}} - 2\sqrt{\gamma_d^+\gamma_d^-} - 2\sqrt{\gamma_l^+\gamma_l^-} + 2\sqrt{\gamma_d^+\gamma_l^-} + 2\sqrt{\gamma_l^+\gamma_d^-} < 0 \tag{8}$$

$$\text{Criterion } (II)\text{: } S_{dl} = \gamma_l - (\gamma_{dl} + \gamma_d) = \gamma_l^{LW} + 2\sqrt{\gamma_l^+\gamma_l^-} - \gamma_d^{LW} - 2\sqrt{\gamma_d^+\gamma_d^-} - \gamma_d^{LW} - \gamma_l^{LW} + 2\sqrt{\gamma_d^{LW}\gamma_l^{LW}} - 2\sqrt{\gamma_d^+\gamma_d^-} - 2\sqrt{\gamma_l^+\gamma_l^-} + 2\sqrt{\gamma_d^+\gamma_l^-} + 2\sqrt{\gamma_l^+\gamma_d^-} < 0 \tag{9}$$

$$\text{Criterion } (III)\text{: } S_{ls} + \gamma_l R = \gamma_s - (\gamma_{ls} + \gamma_l) + \gamma_l R = \gamma_s^{LW} + 2\sqrt{\gamma_s^+\gamma_s^-} - \gamma_l^{LW} - \gamma_s^{LW} + 2\sqrt{\gamma_l^{LW}\gamma_s^{LW}} - 2\sqrt{\gamma_l^+\gamma_l^-} - 2\sqrt{\gamma_s^+\gamma_s^-} + 2\sqrt{\gamma_l^+\gamma_s^-} + 2\sqrt{\gamma_s^+\gamma_l^-} + (R-1)\left(\gamma_l^{LW} + 2\sqrt{\gamma_l^+\gamma_l^-}\right) > 0 \tag{10}$$

$$\text{Criterion } (IV)\text{: } S_{ls(d)} + \gamma_{dl} R = \gamma_{ds} - (\gamma_{ls} + \gamma_{dl}) + \gamma_{dl} R = \gamma_d^{LW} + \gamma_s^{LW} - 2\sqrt{\gamma_d^{LW}\gamma_s^{LW}} + 2\sqrt{\gamma_d^+\gamma_d^-} + 2\sqrt{\gamma_s^+\gamma_s^-} - 2\sqrt{\gamma_d^+\gamma_s^-} - 2\sqrt{\gamma_s^+\gamma_d^-} - \gamma_l^{LW} - \gamma_s^{LW} + 2\sqrt{\gamma_l^{LW}\gamma_s^{LW}} - 2\sqrt{\gamma_l^+\gamma_l^-} - 2\sqrt{\gamma_s^+\gamma_s^-} + 2\sqrt{\gamma_l^+\gamma_s^-} + 2\sqrt{\gamma_s^+\gamma_l^-} + (R-1)\left(\gamma_d^{LW} + \gamma_l^{LW} - 2\sqrt{\gamma_d^{LW}\gamma_l^{LW}} + 2\sqrt{\gamma_d^+\gamma_d^-} + 2\sqrt{\gamma_l^+\gamma_l^-} - 2\sqrt{\gamma_d^+\gamma_l^-} - 2\sqrt{\gamma_l^+\gamma_d^-}\right) > 0 \tag{11}$$

$$\text{Criterion } (V)\text{: } \gamma_{dl} = \gamma_d^{LW} + \gamma_l^{LW} - 2\sqrt{\gamma_d^{LW}\gamma_l^{LW}} + 2\sqrt{\gamma_d^+\gamma_d^-} + 2\sqrt{\gamma_l^+\gamma_l^-} - 2\sqrt{\gamma_d^+\gamma_l^-} - 2\sqrt{\gamma_l^+\gamma_d^-} > 0 \tag{12}$$

These inequalities provide information enabling the design and functionality of LIS. An interesting example is the design of LIS to repel low surface tension fluids such as refrigerants or hydrocarbons, which are often nonpolar. In the case of a nonpolar impinging fluid ($\gamma_d^+=\gamma_d^-=0$), in order to avoid both cloaking (criterion I, Equation 8) and spreading of the impinging fluid on the LIS (criterion II, Equation 9), the combined inequality in Equation 13 must be satisfied. Therefore, it is impossible to meet both criteria I and II if the lubricant is also nonpolar; the lubricant must have some polar component of surface energy in order to avoid both cloaking and spreading of the impinging fluid.

$$\sqrt{\gamma_l^{LW}} + \frac{\sqrt{\gamma_l^+\gamma_l^-}}{\sqrt{\gamma_l^{LW}}} > \sqrt{\gamma_d^{LW}} > \sqrt{\gamma_l^{LW}} \tag{13}$$

There are limitations to the vOCG method when used for the prediction of interfacial energies. Several specific concerns raised are that the base components are systematically greater than the acid components, that experimentally determined surface energy components may depend on the set of fluids chosen for experiments, and that the values of the components may sometimes take negative values. See References 24 and 29. In response to the first concern, the relative magnitudes of the acid and base terms are set by the choice of the components of water, which are typically equal to each other but may be chosen to make typical acid and base values for other fluids comparable as shown by Della Volpe and Siboni. See Reference 29 and 30. The second concern may be addressed by choosing appropriate test fluids when characterizing the surface energy components (see Reference 31), or by choosing many fluids. See References 32 and 33. The final concern is assuaged by noting that negative surface energy component values reported are often of a lesser magnitude than the error of the measurement. See References 29 and 34. Even with the concerns addressed, there may still be significant error in prediction of interfacial energy over a broad range of fluids as pointed out by Kwok (see Reference 35) and Lee (see References 36-38). In addition, in the specific case of LIS, a subset of prior work has used ionic liquids as lubricants; unfortunately, not only is there very limited data on the acid-base components of these liquids (see References 39-41), but the vOCG method would have trouble even with suitable data for pure ionic liquids due to the extent to which ionic liquids and water are mutually soluble, with water changing surface tension by nearly 50% in the presence of certain ionic liquids; therefore, ionic liquids are not considered in this analysis. See References 28 and 42. With these criticisms in mind, there is a wealth of literature on interfacial energy prediction (see References 43-47), including data for the vOCG LW, acid, and base components for over 150 fluids and solids compiled in the Supporting Information along with measurements taken in this study, and the consensus is that the vOCG method is the most versatile choice for a broad range of fluids. See References 27, 28, 30, 34 and 48-49. Indeed, as demonstrated below, its predictive power is not only suitable for LIS, it also offers additional insights that previously proposed design guidelines have not been able to properly capture.

In order to test the validity of the proposed model, experiments were performed with several different combinations of impinging fluids and lubricants on a rough surface comprised of copper oxide (CuO) nanoblades fabricated on a copper tube substrate and subsequently functionalized with a low-surface-energy perfluorinated monolayer coating of trichloro(1H,1H,2H,2H-perfluorooctyl)silane (TFTS). The geometric factor for the CuO surface was R=0.80, indicating that the surface was very rough. Water was used as the impinging fluid on LIS with lubricants of Krytox GPL 101 fluorinated oil, silicone oil (Shin Etsu 5 cSt), and ethanol on the functionalized CuO solid surface. With the Krytox GPL 101 fluorinated oil as a lubricant on the functionalized CuO surface, impinging fluids of toluene and pentane were also tested. The experiments were performed in a sealed environmental chamber. The LIS was first prepared by adding lubricant to the surface and removing excess lubricant with a nitrogen gun, and then the chamber was sealed and impinging fluid was condensed onto the LIS, which was chilled by a flow of controlled-temperature chiller fluid within the tube and observed with a video camera (see Methods: Condensation Experiments). If discrete and mobile droplets were observed on the LIS exterior of the tube where the impinging fluid was condensing, the LIS configuration was deemed successful (see Supporting Information).

For the combination of impinging fluid, lubricant, and solid surface used in each experiment, the expected behaviour was modelled using Equations 9 through 12 and the complete surface energy data for each fluid and solid presented in Table 3 in the Supporting Information below. Equations 9 through 12 must all be satisfied for the model to predict a successful LIS; if one or more of the equations were not satisfied, the failure mode predicted by the model was indicated in Table 1. The experimental results were compared with the model prediction in Table 1, where all of the experiments performed in the present work were in agreement with the model prediction. Interestingly, the model predicted not only the failure in the case with water impinging on the LIS of ethanol on CuO, but also the failure mechanism: criterion (V) was not satisfied, indicating that water and ethanol are miscible, which was the reason for the failure.

TABLE 1

LIS experiments in the present work and other literature compared to the model prediction. The model predicted the experimental results with excellent accuracy, and also predicted the correct failure mode in the failed experimental cases.

| Droplet | Lubricant | Coating/Solid | Experiment | Prediction | Predicted Failure Mode | Ref |
|---|---|---|---|---|---|---|
| Water | Krytox 1506 | TFTS on Si Pillars | ✔ | ✔ | N/A | 17 |
| Toluene | Krytox 1506 | TFTS on Si Pillars | ✔ | ✔ | N/A | " |
| Ethanol | Krytox 1506 | TFTS on Si Pillars | X | X | Displacement of Lubricant | " |
| Octane | Krytox 1506 | TFTS on Si Pillars | ✔ | ✔ | N/A | " |
| Hexane | Krytox 1506 | TFTS on Si Pillars | ✔ | ✔ | N/A | " |
| Pentane | Krytox 1506 | TFTS on Si Pillars | ✔ | ✔ | N/A | " |
| Perfluoro-hexane | Krytox 1506 | TFTS on Si Pillars | X | X | Spreading of Droplet | " |
| Water | Krytox GPL 100 | PTFE Membrane | ✔ | ✔ | N/A | 11 |
| Hexane | Krytox GPL 100 | PTFE Membrane | ✔ | X | Displacement of Lubricant | " |
| Pentane | Krytox GPL 100 | PTFE Membrane | ✔ | X | Displacement of Lubricant | " |
| Water | 10 cSt Si Oil | OTS on Si Pillars | ✔ | ✔ | N/A | 50 |
| Water | 1000 cSt Si Oil | OTS on Si Pillars | ✔ | ✔ | N/A | " |
| Water | Krytox GPL 101 | TFTS on CuO Nanoblades | ✔ | ✔ | N/A | * |
| Water | 5 cSt Si Oil | TFTS on CuO Nanoblades | ✔ | ✔ | N/A | * |
| Water | Ethanol | TFTS on CuO Nanoblades | X | X | Droplet and Lubricant Miscible | * |
| Toluene | Krytox GPL 101 | TFTS on CuO Nanoblades | ✔ | ✔ | N/A | * |
| Pentane | Krytox GPL 101 | TFTS on CuO Nanoblades | ✔ | ✔ | N/A | * |

*present work
"same as above

The model was also validated against experimental results in the literature. Rykaczewski et al. condensed water and low surface tension fluids on a LIS of Krytox 1506 oil infused in TFTS-coated silicon posts (R=0.76) in a procedure similar to the present work. See Reference 17. They found that most of the configurations showed successful LIS promotion of droplet formation, but there were exceptions. In one case, the condensate (ethanol) displaced the lubricant; the model predicted failure in this case due to criterion (IV), where the strong polar interactions between the ethanol and the TFTS coating on the solid surface resulted in displacement of the Krytox oil. In another case, perfluorohexane spread over the LIS, which was also accurately captured as the failure mode by the model when criterion (II) was not met. Wong placed droplets onto a PTFE membrane (estimated R=0.82) infused with Krytox GPL 100 oil (see Reference 11); in this study, all of the experiments were successful. Finally, Anand condensed water onto a LIS of silicone oil (viscosities of 10 and 1,000 cSt) infused in silicon pillars (R=0.57) coated with octadecyltrichlorosilane (OTS) (see Reference 50), where again all of the experiments were successful.

Figure 2:
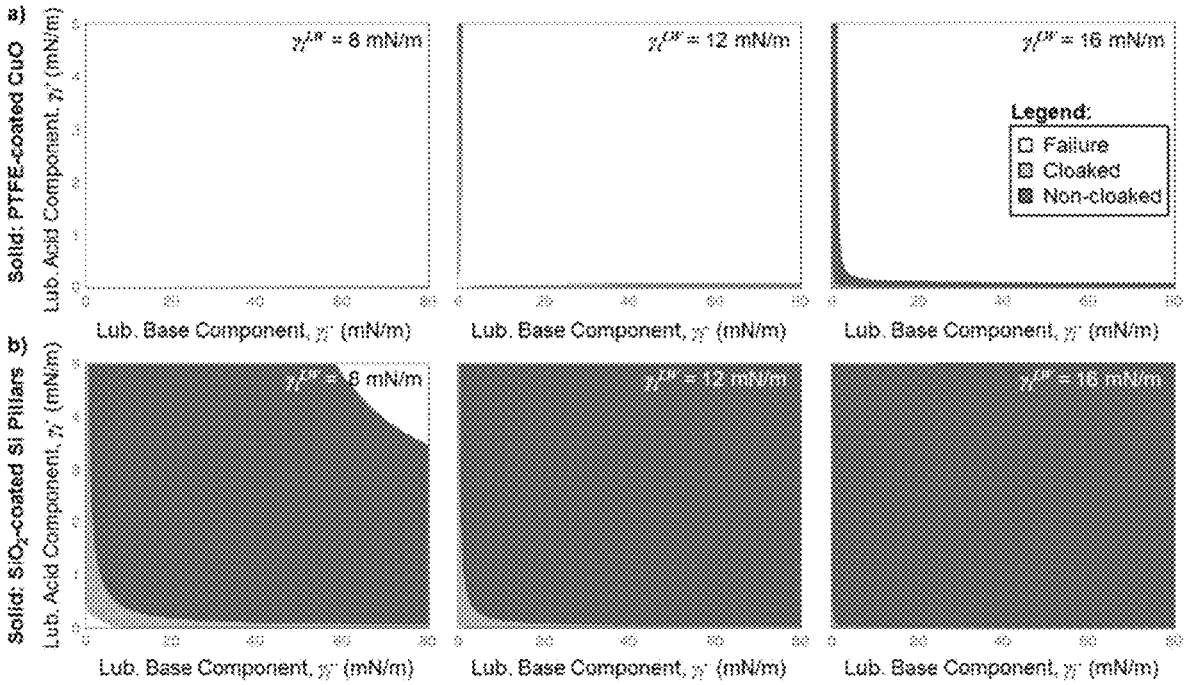
FIG. 2 depicts parametric sweep of lubricant surface energy components $\gamma_l^{LW}$, $\gamma_l^{+}$, and $\gamma_l^{-}$ on two different solid surfaces for a nonpolar impinging fluid with a surface tension of 17 mN/m. Panel A shows a low-surface-energy surface of PTFE coated onto CuO nanoblades (R=0.80) has no possible lubricant to design a LIS when $\gamma_l^{LW}=8$, and the solution domain is limited to nonpolar fluids for higher values of $\gamma_l^{LW}$. Panel B shows a high-surface-energy structured surface of $SiO_2$ pillars (R=0.71) allows a much larger range of potential lubricants, including a wide range of potential fluids which would allow non-cloaked droplet formation (darker region).

Through comparison of the model with 17 total experimental cases, 5 from the present study and 12 from literature, it was found that the model had predicted success or failure of the LIS with nearly 90% accuracy. Of equal importance, in each of the failure cases considered, the model revealed why the failure occurred. With this in mind, the model was used to explore the validity of some common guidelines proposed in the LIS field. First, the question of whether the solid must have a low surface energy was explored (see Reference 50). The model described herein indicates that the solid need not have a low surface energy; in fact, the opposite case appears to be more desirable in some scenarios. FIG. 2 shows a parametric sweep of the three surface energy components (LW, acid, and base) of the lubricant for two different solids: a low-surface-energy PTFE-coated solid in FIG. 2 (panel A) and a high-surface-energy $SiO_2$-coated solid in FIG. 2 (panel B), with the goal of repelling a nonpolar impinging fluid with surface tension 17 mN/m. The range of feasible lubricants for the $SiO_2$ solid surface is much more expansive, including (1) providing possible solutions for $\gamma_l^{LW}$=8 mN/m when the PTFE surface provides none and (2) providing a much larger margin of error to avoid droplet cloaking in all cases by introducing acid-base components to the lubricant and entering the large non-cloaking regions (darker shaded regions). (Note that the model indicates that a nonpolar fluid with surface tension of 16 mN/m is a suitable lubricant for an impinging nonpolar fluid with surface tension of 17 mN/m, which raises concerns about the accuracy of the miscibility criterion (V); the effect of a more conservative miscibility criterion is discussed below.)

Figure 3:
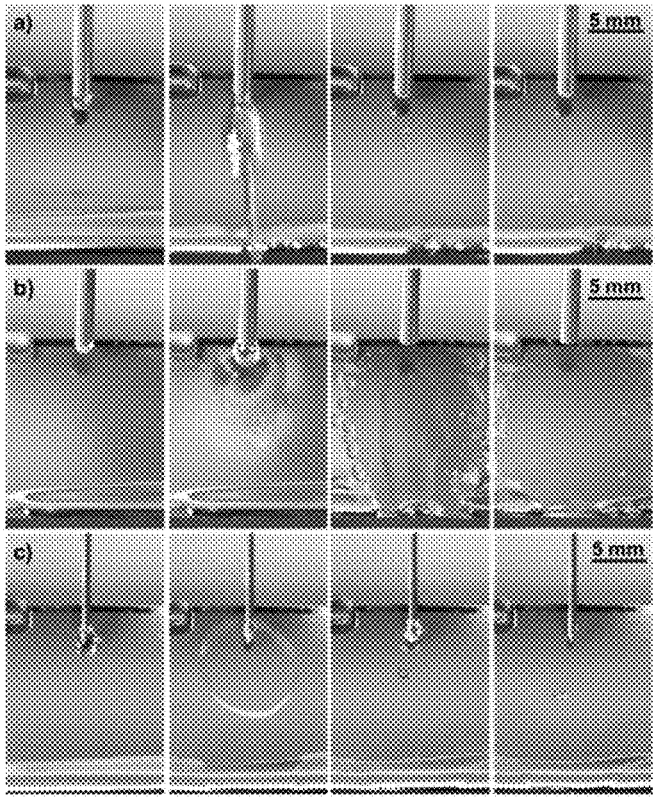
FIG. 3 depicts experimental results from droplet impingement tests for counterintuitive LIS designs. The first frame of each sequence shows the droplet attached to the syringe before impingement. Panel A shows diiodomethane is dropped onto a LIS of methanol infused in $SiO_2$ pillars. Discrete, mobile droplets of diiodomethane form on the LIS and roll down the surface. Panel B shows methanol is dropped onto a LIS of diiodomethane infused in $SiO_2$ pillars. The methanol forces the diiodomethane lubricant out of the $SiO_2$ pillars as predicted by the model. The interface between methanol and diiodomethane is observed propagating outwards from the initial impingement site in the second image in the sequence, and by the final image in the sequence the diiodomethane is completely displaced. Panel C shows heptane is dropped onto a LIS of methanol infused in $SiO_2$ pillars. Discrete droplets of heptane form and slide down the LIS even though the surface tension of heptane is lower than the critical surface energy of $SiO_2$, indicating that LIS allows droplet formation on a solid with a critical surface energy higher than the impinging fluid so long as an appropriate lubricant is chosen.

A LIS with a high-surface-energy solid by using plasma-cleaned $SiO_2$-coated silicon pillars was experimentally tested. These $SiO_2$-coated pillars were fabricated on a silicon wafer, and as such were not able to be applied to the cylindrical exterior of our condenser tubes as used in the previously described experimental setup. The LIS in this case was characterized with a droplet impingement experiment, described in detail in the Supporting Information below. Note that the droplet impingement was performed at a near-zero impact velocity; as a result, fluid hammer pressure and dynamic effects were not significant. As shown in Table 2, the model predicted that methanol could be a suitable lubricant for the impinging fluids diiodomethane and heptane. This is primarily due to the strong Lewis acid-base polar interaction between methanol and $SiO_2$ which helps to satisfy criteria (III) and (IV). FIG. 3 (panels A and C) shows the experimental results in these two cases for a droplet impinging on an inclined surface of $SiO_2$ pillars infused with methanol (see Methods, Droplet Impingement Experiments). The sequence of frames from left to right shows highly-mobile discrete droplets of both diiodomethane and heptane form on the LIS of methanol in $SiO_2$ pillars, indicating a successful LIS in agreement with the model prediction and demonstrating a LIS which utilizes a high-surface-energy solid material in contrast with past work which has relied on low-surface-energy solids. This is particularly useful for future LIS design because thin, low-surface-energy coatings often lack durability (see Reference 20); the details below demonstrate that these coatings are not necessary for LIS.

TABLE 2

LIS combinations counterintuitive to conventional design guidelines. The impinging droplet, lubricant, and solid/coating are described along with their relevant surface energy components. The model prediction for criteria (I) through (V) are shown to the right, and the experiment success or failure is indicated.

| Droplet | Lubricant | Solid/Coating | I | II | III | IV | V | Exp. | FIG. |
|---|---|---|---|---|---|---|---|---|---|
| Diiodomethane | Methanol | Bare $SiO_2$Pillars | | | | | | | |
| ($\gamma$ = 50.8 mN/m)<br>($\gamma^{LW}$ = 50.8 mN/m)<br>($\gamma^+$ = 0.0 mN/m)<br>($\gamma^-$ = 0.0 mN/m) | ($\gamma$ = 22.5 mN/m)<br>($\gamma^{LW}$ = 18.2 mN/m)<br>($\gamma^+$ = 0.1 mN/m)<br>($\gamma^-$ = 77.0 mN/m) | ($\gamma$ = 59.8 mN/m)<br>($\gamma^{LW}$ = 42.0 mN/m)<br>($\gamma^+$ = 2.0 mN/m)<br>($\gamma^-$ = 40.2 mN/m) | X | ✔ | ✔ | ✔ | ✔ | ✔ | 3(A) |
| Methanol | Diiodomethane | Bare $SiO_2$Pillars | | | | | | | |
| ($\gamma$ = 22.5 mN/m)<br>($\gamma^{LW}$ = 18.2 mN/m)<br>($\gamma^+$ = 0.1 mN/m)<br>($\gamma^-$ = 77.0 mN/m) | ($\gamma$ = 50.8 mN/n)<br>($\gamma^{LW}$ = 50.8 mN/m)<br>($\gamma^+$ = 0.0 mN/m)<br>($\gamma^-$ = 0.0 mN/m) | ($\gamma$ = 59.8 mN/m)<br>($\gamma^{LW}$ = 42.0 mN/m)<br>($\gamma^+$ = 2.0 mN/m)<br>($\gamma^-$ = 40.2 mN/m) | ✔ | X | ✔ | X | ✔ | X | 3(B) |
| Heptane | Methanol | Bare $SiO_2$Pillars | | | | | | | |
| ($\gamma$ = 20.1 mN/m)<br>($\gamma^{LW}$ = 20.1 mN/m)<br>($\gamma^+$ = 0.0 mN/m)<br>($\gamma^-$ = 0.0 mN/m) | ($\gamma$ = 22.5 mN/n)<br>($\gamma^{LW}$ = 18.2 mN/m)<br>($\gamma^+$ = 0.1 mN/m)<br>($\gamma^-$ = 77.0 mN/m) | ($\gamma$ = 59.8 mN/m)<br>($\gamma^{LW}$ = 42.0 mN/m)<br>($\gamma^+$ = 2.0 mN/m)<br>($\gamma^-$ = 40.2 mN/m) | ✔ | ✔ | ✔ | ✔ | ✔ | ✔ | 3(C) |
| Butane | Hexafluoro-IPA | Bare $SiO_2$Pillars | | | | | | | |
| ($\gamma$ = 12.5 mN/m)<br>($\gamma^{LW}$ = 12.5 mN/m)<br>($\gamma^+$ = 0.0 mN/m)<br>($\gamma^-$ = 0.0 mN/m) | ($\gamma$ = 14.7 mN/m)<br>($\gamma^{LW}$ ≈ 10.4 mN/m)<br>($\gamma^+$ ≈ 0.0 mN/m)<br>($\gamma^-$ ≈ 70.0 mN/m) | ($\gamma$ = 59.8 mN/m)<br>($\gamma^{LW}$ = 42.0 mN/m)<br>($\gamma^+$ = 2.0 mN/m)<br>($\gamma^-$ = 40.2 mN/m) | ✔ | ✔ | ✔ | ✔ | ✔ | ✔ | 4 |

Even more intriguing is the consideration of whether LIS can be used to promote droplet formation for impinging fluids with surface tensions below the critical surface energy of the solid. See Reference 17. Certainly, droplets will not form for a fluid impinging directly onto a solid if the fluid has a surface tension lower than the solid's relevant critical surface energy by definition. However, our model predicts that a suitably-designed LIS can promote formation of droplets with finite wetting angle even when the impinging fluid has a surface energy lower than that of the solid surface. Specifically, we have chosen the example of $SiO_2$ pillars with methanol as the lubricating fluid and heptane as the impinging fluid, where the lowest reported critical surface tension of $SiO_2$ is 27.7 mN/m (see Reference 51 and 52 and the surface tension of heptane is 20.1 mN/m. In this case, the model predicts that all of the criteria (I) through (V) will be satisfied. Criteria (III) and (IV) are once again satisfied due to the strong polar affinity between methanol and $SiO_2$. The model also predicts that Equation 13 will be satisfied to avoid both droplet cloaking and spreading of the nonpolar impinging fluid this is possible due to methanol having a lower LW component of surface energy than heptane while also having a sufficiently large polar component of surface energy. The results of the experiment with this LIS configuration are shown in FIG. 3 (panel c), where discrete and mobile droplets of heptane form on the methanol/$SiO_2$ LIS in agreement with the model prediction. This demonstration indicates that the LIS enables formation of discrete droplets on a solid surface with a critical surface energy higher than that of the impinging droplets, so long as an appropriate lubricating fluid is chosen.

It was also considered whether the lubricating fluid should have a surface tension similar to that of the solid surface. See Reference 53. The experiment shown in FIG. 3 (panel a) indicated that methanol is a suitable lubricant for the $SiO_2$ solid surface despite having an overall surface energy of less than 40% that of $SiO_2$. One can consider the reverse case, where methanol was taken as the impinging fluid and diiodomethane, with a better "matching" surface energy 85% that of $SiO_2$, was taken as the lubricant. In this case, the model predicted that the strong polar affinity between the methanol and the $SiO_2$ would not allow criterion (IV) to be satisfied and would consequently result in forced dewetting of the diiodomethane from the $SiO_2$ pillars even though the diiodomethane has a surface energy much more closely matched to that of the $SiO_2$. The experimental result from the droplet impingement test is shown in FIG. 3 (panel b), where the diiodomethane is indeed forced out of the $SiO_2$ pillars by the methanol with the interface between the two observed propagating away from the impingement site until the diiodomethane is completely displaced. This result demonstrates that the overall surface energies of the lubricant and the solid surface need not necessarily match.

Figure 4:
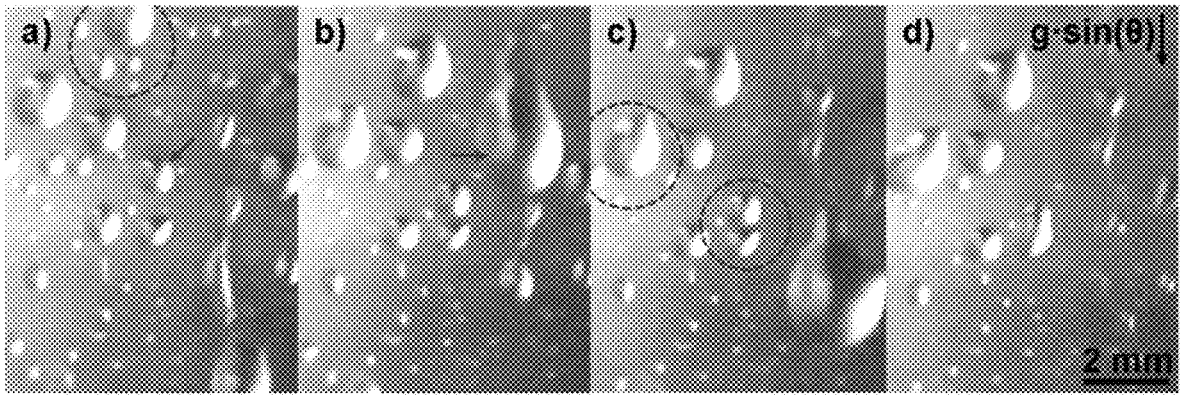
FIG. 4 depicts behavior of liquid butane impinging on a LIS of 6F-IPA infused in silicon micropillars. The experiment was performed inside of a glass vial at elevated pressure. Photos (panel A) through (panel D) are time lapse images of droplets moving on the LIS after being sprayed on the surface. The dashed red circles indicate when droplet coalescence events are about to occur, and the red arrows indicate droplets sliding on the surface, which occur at approximately the capillary length (1.4 mm) in this case. Droplets of butane deposited onto a flat $SiO_2$ surface in the same experimental setup immediately spread over the surface.

Finally, one can take advantage of the potential for a strong polar interaction between the lubricant and a high-surface-energy solid to design a LIS to repel extremely low surface tension impinging fluids. Previously, multiple reports have indicated that LIS are able to repel pentane ($\gamma \approx 17$ mN/m), (see Reference 11 and 17), but lower surface tension fluids such as perfluorohexane ($\gamma \approx 11$ mN/m) could not be repelled. We used the same $SiO_2$ pillared solid surface as in the experiments shown in FIG. 3, but we chose hexafluoroisopropanol (6F-IPA) as the lubricant in order to maintain the strong polar interaction through the presence of its —OH group while simultaneously exhibiting a significantly lower LW component of surface energy compared to methanol due to the fluorination. The model predicted that this surface would be able to repel nonpolar impinging fluids with surface tensions as low as ≈11 mN/m; an experiment was performed with butane ($\gamma \approx 13$ mN/m) as the impinging fluid. The experimental setup was modified by placing it inside a glass vial to accommodate butane's super-atmospheric vapor pressure (≈2.5 atm) at standard temperature, which resulted in a limited field of view. A control experiment was first performed during which we sprayed droplets of butane onto a flat plasma-cleaned $SiO_2$ surface and found that butane droplets impinging onto the flat $SiO_2$ surface spread completely, as expected due to the surface tension of butane being lower than the critical surface energy of $SiO_2$. Butane droplets were then sprayed onto the proposed LIS of 6F-IPA infused into the $SiO_2$ pillars, with the result shown in FIG. 4. Discrete droplets formed on the surface, and the droplets exhibited a high degree of mobility as well as typical droplet behavior such as multiple sweeping and coalescence events.

The energy-based analysis presented in this work is useful in eliminating combinations of impinging fluid, lubricant, and solid surface that are guaranteed to fail, but prediction of a successful LIS with our model does not guarantee desired performance in every application. It is possible in certain applications that other criteria must also be met for a successful LIS. For example, when repelling high-speed impinging droplets, the fluid hammer pressure and dynamic droplet behavior must be accounted for. See Reference 54. In applications involving flow of an impinging fluid over the LIS, shear at the impinging fluid-lubricant interface may result in lubricant depletion as it is forced out of the structured surface. See Reference 2. In any open system, evaporation of the lubricant from the surface over extended periods of time may also be a concern. Gravity may even drive lubricant depletion for large enough surfaces (see discussion in Supporting Information below). Fortunately, the fundamental understanding of surface energetics presented here offers an excellent starting point for the design of any lubricant infused surface.

A model was developed which predicts interfacial surface energies to determine whether an arbitrary combination of solid and lubricant will repel a given impinging fluid. This model was validated against experiments performed in the present work as well as the literature and subsequently used to develop a new framework for LIS design and provide unique design guidelines. Furthermore, LIS was demonstrated on uncoated high-surface-energy solids, eliminating the need for unreliable low-surface-energy coatings. The vOCG-based approach to LIS design using high-surface-energy solids and polar lubricants resulted in repulsion of discrete droplets of the lowest surface tension fluid recorded to date (butane, $\gamma \approx 13$ mN/m). This demonstration of LIS repelling extremely low-surface-tension fluids is promising for applications in thermal management (see References 14 and 55) and hydrocarbon processing. See Reference 17. More broadly, the insights gained from the vOCG framework will promote new developments in LIS design, paving the way for new technology in biological science, lab-on-a-chip, thermofluidics, and beyond.

Materials and Methods

Experimental Design: Condensation Experiments

Condensation experiments were performed inside of a controlled environmental chamber. TFTS-functionalized CuO coatings were applied to the exterior surface of copper condenser tubes. See Reference 56. The TFTS-coated CuO was infused with lubricant by first placing a few droplets of lubricant onto the surface and allowing them to spread completely, then using a nitrogen stream (99.9%, Airgas) to shear off excess lubricant. Following the addition of lubricant, the chamber was sealed and noncondensable gases were evacuated with a vacuum pump (except in the case of the ethanol lubricant, where the vacuum pump was not used so as not to evaporate the ethanol). Pure vapor of the impinging condensate was then introduced as the tube sample was cooled from within with a chiller loop set to 15° C. The behavior of the condensate was imaged from a viewport during condensation.

Experimental Design: Droplet Impingement Experiments

Droplet impingement experiments were performed with the LIS held at ≈45° from horizontal inside of a fume hood. Excess lubricant was added to the base of the dry, plasma cleaned. See Reference 57. $SiO_2$ pillar structured surface and allowed to wick into the $SiO_2$ pillars until they were filled with lubricant. The droplets of the impinging fluid were then dispensed from a syringe with a stainless steel needle. Images were taken at an angle of ≈0° from horizontal with a camera outside of the hood. For the experiment with butane as the impinging fluid, in order to prevent rapid evaporation of butane, the LIS was placed inside of a glass vial, infused with the 6F-IPA, then a small amount of butane was placed at the bottom of the vial and the vial was sealed and allowed to reach saturation conditions. Butane droplets were then introduced through a port at the top of the vial.

Pendant Drop Measurements—

The surface energy components were determined for Krytox oil using the pendant drop method to characterize the interfacial tension of Krytox oil with multiple test liquids including water, ethylene glycol, glycerol, 1-bromonapthalene, and chloroform. The pendant drop measurement system consisted of a collimated light source (Thorlabs 6500 K, 440 mW Collimated LED) illuminating the droplet and aligned with a telecentric lens (Edmund 0.25× SilverTL) attached to a camera (PointGrey CM3-U3-13Y3C) capturing images. The droplets were dispensed with a Harvard Apparatus syringe pump through stainless steel needles, and when interfacial tension between two fluids was measured, the second fluid was contained inside of a glass cuvette. Glass cuvettes were cleaned thoroughly with Alconox followed by progressive solvent rinses in acetone, methanol, ethanol, isopropanol, and finally 99.99% pure DI water, and then nitrogen stream drying (99.9%, Airgas). Interfacial tensions were characterized from images using a plugin for ImageJ. See Reference 58. The surface energy components were determined from a plane fit to the data based on the vOCG equations, detailed in the Supporting Information.

Surface Fabrication—

To create the CuO nanostructures, commercially available oxygen-free Cu tubes (99.9% purity) with outer diameters, $D_{OD}$=6.35 mm, inner diameters, $D_{ID}$=3.56 mm, and lengths, L=131 mm, were used. Each Cu tube was cleaned in an ultrasonic bath with acetone for 10 minutes and rinsed with ethanol, isopropanol, and de-ionized (DI) water. The tubes were then dipped into a 2.0 M hydrochloric acid solution for 10 minutes to remove the native oxide film on the surface, then triple-rinsed with DI water and dried with clean nitrogen gas. Nanostructured CuO films were formed by immersing the cleaned tubes (with ends capped) into a hot (96±3° C.) alkaline solution composed of $NaClO_2$, NaOH, $Na_3PO_4.12H_2O$, and DI water (3.75:5:10:100 wt. %). See Reference 59-62. During the oxidation process, a thin (≈300 nm) $Cu_2O$ layer was formed that then re-oxidized to form sharp, knife-like CuO oxide structures with heights of h≈1 μm, solid fraction φ≈0.038 and roughness factor r≈4.

Silicon micropillar surfaces (FIG. 4*d*) with diameters of d=7 μm, heights of h=20 μm, and center-to-center spacings of l=20 μm (solid fraction $\varphi=\pi d^2/4l^2=0.096$ and roughness factor $r=1+\pi dh/l^2=3.20$) were fabricated using projection lithography and deep reactive ion etching.

Surface Functionalization— trichloro(1H,1H,2H,2H-perfluorooctyl)silane (TFTS) (Sigma-Aldrich) was deposited from the vapor phase. Prior to silane deposition, each tube was oxygen plasma cleaned for 2 hours to remove organic contaminants on the surface. Once clean, the tube samples were immediately placed in a vacuum desiccator (06514-10, Cole Parmer) with a small amount of liquid TFTS. The desiccator was evacuated by a roughing pump for 2 minutes to a minimum pressure of ≈2 kPa. A valve was then closed to isolate the pump from the desiccator and the sample was held in vacuum (≈2 kPa) for another 10 minutes. The functionalized surfaces was then rinsed in ethanol and DI water and dried in a clean nitrogen stream. The coating had a typical advancing angle of $\theta_a$≈120° when measured on a smooth reference surface and typical advancing/receding angles of $\theta_a/\theta_r$≈171/167±3° when measured on the nanostructured CuO surface.

Supplemental Information vOCG Surface Energy Components

TABLE 3

Compilation of vOCG surface energy components for 167 fluids and solids:

| Fluid/Solid | $\gamma$ (mN/m) | $\gamma^{LW}$ (mN/m) | $\gamma^{AB}$ (mN/m) | $\gamma^{+}$ (mN/m) | $\gamma^{-}$ (mN/m) | SI Ref. |
|---|---|---|---|---|---|---|
| Benzene | 28.9 | 28.9 | 0 | 0 | 0.96 | 1 |
| Chlorobenzene | 33.6 | 32.1 | 1.5 | 0.9 | 0.61 | 2 |
| Chloroform (Trichloromethane) | 27.2 | 27.2 | 0 | 1.5 | 0 | 3 |
| Cyclohexane | 25.24 | 25.24 | 0 | 0 | 0 | 2 |
| cis-Decahydrohaphthalene | 32.2 | 32.2 | 0 | 0 | 0 | 3 |
| Decane | 23.83 | 23.83 | 0 | 0 | 0 | 2 |
| Diethyl Ether (ethoxyethane) | 17 | 17 | 0 | — | — | 3 |
| Diiodomethane | 50.8 | 50.8 | 0 | 0 | 0 | 2 |
| Diiodomethane | 50.8 | 49 | 1.8 | 0.01 | 0 | 4* |
| Diiodomethane | 50.8 | 44.1 | 6.7 | 0.01 | 0 | 4** |
| Diiodomethane | 50.8 | 48.5 | 2.3 | 0.01 | | 5 |
| Dimethylsulfoxide | 44 | 36 | 8 | 0.5 | 32 | 2 |
| Dodecane | 25.35 | 25.35 | 0 | 0 | 0 | " |
| Eicosane | 28.87 | 28.87 | 0 | 0 | 0 | " |
| Ethanol | 22.4 | 18.8 | 2.6 | 0.019 | 68 | " |
| Ethyl acetate (ethyl ethanoate) | 23.9 | 23.9 | 0 | 0 | 6.2 | 3 |
| Ethylene Glycol | 48 | 29 | 19 | 1.92 | 47 | 2 |
| Ethylene Glycol | 48 | 29 | 19 | 3 | 30.1 | 3 |
| Ethylene Glycol | 48.8 | 32.8 | 16 | 3 | 30.1 | 6 |
| Formamide | 58 | 39 | 19 | 0.5 | 32 | 2 |
| Formamide | 58 | 39 | 19 | 2.28 | 39.6 | 3 |
| Formamide | 58.2 | 36 | 22.2 | 2.29 | 39.6 | 4* |
| Formamide | 57.9 | 34.3 | 23.5 | 2.28 | 39.6 | 6 |

TABLE 3-continued

| | | | | | | |
|---|---|---|---|---|---|---|
| Formamide | 58.2 | 39.5 | 18.7 | 2.28 | 39.6 | 5 |
| Glycerol | 64 | 34 | 30 | 3.92 | 57.4 | 2 |
| Glycerol | 63.4 | 40.6 | 22.8 | 3.92 | 57.4 | 4* |
| Glycerol | 63.4 | 37 | 26.4 | 3.92 | 57.4 | 6 |
| Heptane | 20.14 | 20.14 | 0 | 0 | 0 | 2 |
| Hexadecane | 27.47 | 27.47 | 0 | 0 | 0 | " |
| Hexane | 18.4 | 18.4 | 0 | 0 | 0 | " |
| Methanol | 22.5 | 18.2 | 4.3 | 0.06 | 77 | " |
| Methyl-ethyl-ketone | 24.6 | 24.6 | 0 | 0 | 24 | " |
| Nitrobenzene | 43.9 | 41.3 | 2.6 | 0.26 | 6.6 | " |
| Nonadecane | 28.59 | 28.59 | 0 | 0 | 0 | " |
| Nonane | 22.85 | 22.85 | 0 | 0 | 0 | " |
| Octane | 21.62 | 21.62 | 0 | 0 | 0 | " |
| Perfluoroheptane | 12.8 | 12.8 | 0 | 0 | 0 | 7 |

| Fluid/Solid | $\gamma$ (mN/m) | $\gamma^{LW}$ (mN/m) | $\gamma^{AB}$ (mN/m) | $\gamma^{+}$ (mN/m) | $\gamma^{-}$ (mN/m) | Ref. |
|---|---|---|---|---|---|---|
| Perfluorohexane (FC-72) | 12.0 | (12.0) | (0) | (0) | (0) | 8 |
| Perfluorohexane (FC-72) | 10.0 | (10.0) | (0) | (0) | (0) | 9 |
| Pentadecane | 27.07 | 27.07 | 0 | 0 | 0 | 2 |
| Pentane | 16.05 | 16.05 | 0 | 0 | 0 | " |
| Silicone Oil | 18.8 | 18.8 | 0 | 0 | 0 | 10 |
| Tetradecane | 26.56 | 26.56 | 0 | 0 | 0 | 2 |
| Tetrahydrofuran | 27.4 | 27.4 | 0 | 0 | 15 | " |
| Tricresyl phosphate | 40.9 | 39.8 | 1.1 | | | 4* |
| Tricresyl phosphate | 40.9 | 39.7 | 1.2 | | | 4*** |
| Tricresyl phosphate | 40.9 | 39.2 | 1.7 | | | 5 |
| Tridecane | 25.99 | 25.99 | 0 | 0 | 0 | 2 |
| Toluene | 28.5 | 28.5 | 0 | 0 | 0.72 | 3 |
| Undecane | 24.66 | 24.66 | 0 | 0 | 0 | 2 |
| Water | 72.8 | 21.8 | 51 | 25.5 | 25.5 | " |
| Water | 72.8 | 22.6 | 50.2 | 25.5 | 25.5 | 4* |
| Water | 72.8 | 22.1 | 50.7 | 25.5 | 25.5 | 4** |
| o-Xylene | 30.1 | 30.1 | 0 | 0 | 0.58 | 3 |
| β-Bromonaphthalene | 44.4 | 44.4 | 0 | 0 | 0 | 2 |
| 2-Ethoxyethanol | 28.6 | 23.6 | 5 | | | 3 |
| Polyethylene oxide, PEO 6000 | 43 | 43 | 0 | 0 | 64 | 1 |
| Dextran 10000 | 61.2 | 47.4 | 13.8 | 1 | 47.4 | " |
| Fluorocarbon polymer, FC 721 | 9.41 | 9.15 | 0.24 | 0.16 | 0.76 | 11 |
| Polydimethylsiloxane, PDMS | 23.1 | 22.9 | 0.12 | 0 | 3.05 | 12 |
| Poly(methyl methacrylate), PMMA | 39-43 | 39-43 | 0 | 0 | 9.5-22.4 | 13 |
| Poly(methyl methacrylate), PMMA | 48.9 | 46.5 | 2.4 | 0.08 | 18.1 | 14 |
| Poly(methyl methacrylate), PMMA | 46.4 | 44.4 | 1.92 | 0.03 | 27.9 | 12 |
| Polyvinyl acetate, PVAc | 44.5 | 42.6 | 1.9 | 0.041 | 22.3 | 14 |
| Polyvinyl chloride, PVC | 43.7 | 43 | 0.7 | 0.04 | 3.5 | 13 |
| Polyvinyl chloride, PVC | 43.1 | 40.2 | 2.9 | 0.42 | 5.1 | 14 |
| Polystyrene, PS | 42 | 42 | 0 | 0 | 1.1 | 13 |
| PS (based on advancing CA) | 44.9 | 44.9 | 0 | 0 | 1.33 | 15 |
| PS (based on receding CA) | 49.9 | 49.9 | 0 | 0 | 5.14 | " |
| Polyethylene, PE (based on advancing CA) | 33 | 33 | 0 | 0 | 0.1 | 13 |
| PE (based on receding CA) | 57.9-62.5 | 42 | 15.9-20.5 | 2.1 | 30-50 | " |
| Polyethylene glycol, PEG-silane-modified | 47.9 | 45.3 | 2.59 | 0.04 | 39.92 | 12 |
| Polyamide-imide, PAI | 52.6 | 42.8 | 9.8 | 1.04 | 23.15 | 16 |
| Polyhydroxyethylmethacrylate, PHEMA | 50.6 | 40.2 | 10.4 | 2.07 | 13.1 | 17 |
| P(HEMA80/EMA20) | 48.2 | 40.7 | 7.5 | 0.63 | 22.7 | " |
| P(HEMA40/EMA60) | 39.8 | 39.4 | 0.4 | 0.02 | 16.4 | " |
| Polypyrrole, PPyTS | 47 | 41 | 6 | 0.81 | 10.9 | 18 |
| PPyCl | 43.5 | 36.6 | 6.9 | 0.43 | 28.3 | " |
| PPyDS | 41.7 | 34.8 | 6.9 | 1.35 | 8.85 | " |
| Poly(3-octylthiophene) (POT), undoped | | 22.5 | | | 0.5 | 19 |
| POT-AuCl-4 | | 23.4-25 | | | 0.7-4.7 | " |
| Polystyrene, PS | 41.9 | 41.9 | 0.22 | 0.08 | 0.15 | 12 |
| PS latices (Anionic) (advancing) | 41.4 | 41.4 | 0 | 0 | 13.13 | 15 |
| PS latices (Anionic) (receding) | 57.6 | 50.8 | 6.8 | 1.19 | 9.73 | " |
| PS latices (Cationic) (using water/ethylene glycol) | | 39.4-41.9 | | 0-0.4 | 0.3-7 | " |
| PS latices (Cationic) (using water/formamide) | | 39.4-41.9 | | 0-0.1 | 1.8-8.2 | " |
| Polypropylene, PP | 32.2 | 30.1 | 2.1 | 0.3 | 3.8 | 20 |
| PP | 25.7 | 25.7 | 0 | 0 | 0 | 21 |
| PP | 29.7 | 29.7 | 0 | 0 | 1.4 | 22 |

TABLE 3-continued

| | | | | | | |
|---|---|---|---|---|---|---|
| PP-O2 plasma | 43.1 | 36.7 | 6.4 | 0.5 | 22 | 20 |
| PP-N2 plasma | 53.3 | 41.9 | 11.4 | 1 | 30.9 | " |
| PP-NH3 plasma | 42.6 | 34.9 | 7.7 | 0.7 | 21.4 | " |
| Fluorinated ethylene-propylene (FEP) | 15.71 | 15.42 | 0.34 | 0.01 | 0.72 | 11 |
| FEP | 18.3 | 18.3 | 0 | 0 | 0 | 23 |
| Poly(tetrafluoroethylene), PTFE | 19.6 | 19.6 | 0 | 0 | 0 | 24, 25 |
| Poly(tetrafluoroethylene), PTFE | 20.8 | 19.9 | 0.9 | 0.1 | 1.6 | 3 |
| Polyisobutylene, PIS | 25 | 25 | 0 | 0 | 0 | 21, 25 |
| Polyaurinlactam, PA 12 | 41.9 | 37.5 | 4.4 | 1 | 4.9 | 23 |
| Nylon (PA) 66 | 42.8 | 38.6 | 4.2 | 0.4 | 11.3 | " |
| Nylon 66 | 37.7 | 36.4 | 1.3 | 0.02 | 21.6 | 24, 26 |
| Polyvinyl pyrrolidone, PVPY | 43.4 | 43.4 | 0 | 0 | 29.9 | 25 |
| Polyvinyl fluoride, PVF | 43.6 | 40.4 | 3.2 | 0.16 | 12.9 | 27 |
| Polypropylene/EPDM, flame treated | 43.7 | 25.9 | 17.8 | 2.6 | 30.3 | 22 |
| Polyoxytretramethylene glycol), MW 2000 | 44 | 41.4 | 2.6 | 0.06 | 27.6 | 28 |
| Polyoxyethylene, POE, PEG-6000 | 43 | 43 | 0 | 0 | 64 | 29 |
| Polyethylene terephthalate | 43.84 | 43.48 | 0.36 | 0.003 | 7.17 | 11 |
| Ethylene glycol-co-propylene glycol, MW 2000 | 47.5 | 42 | 5.5 | 0.13 | 58.8 | 28 |
| Ethylene glycol-co-propylene glycol, MW 1000 | 47.9 | 40.9 | 7 | 0.22 | 55.6 | " |
| Oriented polypropylene, OPP (advancing) | 32.6 | 32.6 | 0 | 0 | 0 | 30 |
| OPP (receding) | 39.2 | 37 | 2.2 | 1.3 | 0.9 | " |
| OPP-air Corona-treated (advancing) | 55.8 | 42 | 13.9 | 1.9 | 25.2 | " |
| OPP-air Corona-treated (receding) | 64.7 | 46.2 | 18.5 | 2 | 25.2 | " |
| Trimethoxy(octadecyl)silane (OTS) | 23.5 | 23.3 | 0.19 | 0.01 | 1.1 | 12 |
| Zoltek carbon fibers, unsized | 41.3 | 41.3 | 0 | 0 | 32.4 | 19 |
| Zoltek carbon fibers, Ultem sized | 40.2 | 38.6 | 1.6 | 0.03 | 20.5 | " |
| Zoltek carbon fibers, PU sized | 35.8 | 33.2 | 2.6 | 0.11 | 15.3 | " |
| Chromium | 59.6 | 45.8 | 13.8 | 0.86 | 55.5 | 14 |
| Aluminum | 57.4 | 46.7 | 10.7 | 0.5 | 57.5 | " |
| Silicon wafer | 61.9 | 38.6 | 23.3 | 4 | 33.98 | 31 |
| Glass | 59.3 | 42.03 | 17.8 | 1.97 | 40.22 | " |
| Glass, H2SO4/HNO3 | 64.5 | 42.03 | 22.47 | 2.82 | 44.76 | " |
| Glass, C18 | 26.8 | 25.7 | 1.12 | 0.24 | 1.32 | " |
| Glass, APS-treated | 45 | 39.2 | 5.76 | 0.084 | 98.62 | 12 |
| HSA, dry, pH 4.8 | 45 | 44 | 0.1 | 0.03 | 76 | 32 |
| HSA, dry, pH 7 | 41.4 | 41 | 0.4 | 0.002 | 20 | " |
| HSA, hydrated, pH 7 | 62.5 | 26.8 | 35.7 | 6.3 | 50.6 | " |
| HIg-G, hydrated, pH 7 | 51.3 | 34 | 17.3 | 1.5 | 49.6 | " |
| HIg-A, hydrated, pH 7 | 26.8 | 26.8 | 0 | 0 | 93 | " |
| Bovine fibrinogen, dry | 40.3 | 40.3 | 0 | 0 | 53.2 | " |
| Human fibrinogen, dry | 40.6 | 40.6 | 0 | 0 | 54.9 | " |
| HLDLP, dry | 41.1 | 35.5 | 5.66 | 0.26 | 30.8 | " |
| *Candida abicans* (yeast) cultured at 30 C. | 42.5 | 38.1 | 4.4 | 2.9 | 1.7 | 33 |
| *Candida abicans* (yeast) cultured at 37 C. | 47.7 | 37.3 | 10.4 | 0.6 | 43.7 | " |
| *Streptococcus gordonii* (bacteria) cultured at 37 C. | 38.9 | 35.8 | 3.1 | 4.2 | 0.6 | " |
| *Streptococcus oralis* 34 | 57 | 35 | 22 | 2.7 | 45 | 34 |
| *Streptococcus oralis* J22 | 48.7 | 38 | 10.68 | 0.5 | 57 | " |
| *Actinomyces naeslundii* 5951 | 44 | 38 | 6 | 0.5 | 18 | " |
| *Actinomyces naeslundii* 5519 | 40 | 37 | 2.97 | 0.1 | 22 | " |
| Pressure-sensitive adhesive, PSA | 16.7 | 12.6 | 4.1 | 0.42 | 9.9 | 14 |
| Cellulose acetate | 40.2 | 35 | 5.2 | 0.3 | 22.7 | 13 |
| Cellulose nitrate | 45 | 45 | 0 | 0 | 16 | 13 |
| Agarose | 44.1 | 41 | 3.1 | 0.1 | 24 | " |
| Gelatin | 38 | 38 | 0 | 0 | 19 | " |
| Paraffin | 25.5 | 25.5 | 0 | 0 | 0 | 35 |
| Krytox 100 | 15.9 | 11.7 | 0.115 | 0.016 | 0.200 | 36 |

TABLE 3-continued

| | | | | | | |
|---|---|---|---|---|---|---|
| Krytox 105 | 18.8 | 12.7 | 0.049 | 0.028 | 0.021 | " |
| Trichloro(1H,1H,2H,2H-perfluorooctyl)silane (TFTS) (advancing contact angles) | 8.0 | 7.6 | 0.48 | 0.64 | 0.09 | 37 |
| Trichloro(1H,1H,2H,2H-perfluorooctyl)silane (TFTS) (receding contact angles) | 24.5 | 24.9 | 0.48 | 0.01 | 5.76 | " |
| Trichloro(1H,1H,2H,2H-perfluorooctyl)silane (TFTS) (23° C. anneal) | 17.07 | 11.28 | 3.38 | 2.36 | 1.21 | 38 |
| Trichloro(1H,1H,2H,2H-perfluorooctyl)silane (TFTS) (150° C. anneal) | 8.41 | 5.35 | 2.47 | 2.68 | 0.57 | " |
| Trichloro(3,3,3-trifluoropropyl) silane (FPTS) (23° C. anneal) | 29.05 | 18.01 | 4.70 | 3.43 | 1.61 | " |
| Trichloro(3,3,3-trifluoropropyl) silane (FPTS) (150° C. anneal) | 14.48 | 10.62 | 0.40 | 3.72 | 0.11 | " |
| Clean glass (advancing contact angles) | 51.1 | 40.8 | 10.92 | 0.49 | 60.84 | 37 |

Figure 5:
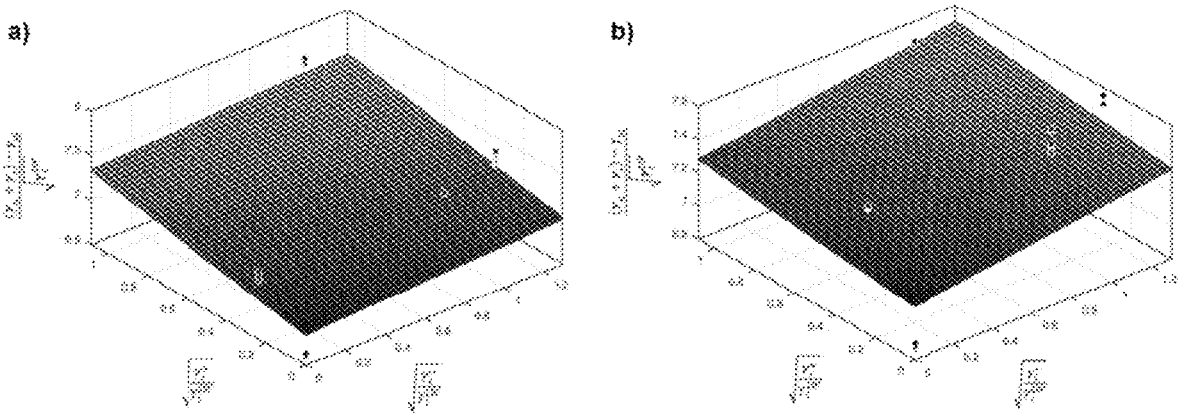
FIG. 5 depicts planar regression to determine vOCG surface energy components. Each measurement in the pendant drop experiment is represented by a point on the plot. The intercept and two slopes give the best-fit values for the LW, acid, and base surface energy components. The regression is shown here for (a) Krytox GPL 100 and (b) Krytox GPL 105 with results shown in Table 3 above, and the error from this process was determined to be less than 1 mN/m for each of the predicted surface energy components. A linear interpolation/extrapolation with these values may be used to approximate the surface energy components of Krytox GPL oils ranging from 100-107.

*from contact angle measurement
**from interfacial tension measurement
*from contact angle data on poly(methyl methacrylate) (parenthesis) indicate estimated value Determination of vOCG Surface Energy Components The vOCG surface energy components for undocumented fluids were determined by plane fitting experimental data points determined from at least three different test fluids. In the present work, the test fluids water, glycerol, ethylene glycol, 1-bromonapthalene, and chloroform were chosen. Equation 14 shows the form of the plane equation, where the left-hand-side corresponds to the vertical axis in FIG. 5** and the right hand side contains two slope terms and the intercept. The subscript "u" indicates the fluid with unknown vOCG components which must be solved for, the subscript "i" represents the i-th test fluid for which the vOCG terms are known, and the interfacial tensions $\gamma_u$ and $\gamma_{ui}$ are measured experimentally.

$$\frac{(\gamma_u+\gamma_i)-\gamma_{ui}}{\sqrt{\gamma_i^{LW}}}=\sqrt{\gamma_u^+}\sqrt{\frac{\gamma_i^-}{\gamma_i^{LW}}}+\sqrt{\gamma_u^-}\sqrt{\frac{\gamma_i^+}{\gamma_i^{LW}}}+2\sqrt{\gamma_u^{LW}} \tag{14}$$

Impact of Surface Geometry

Figure 6:
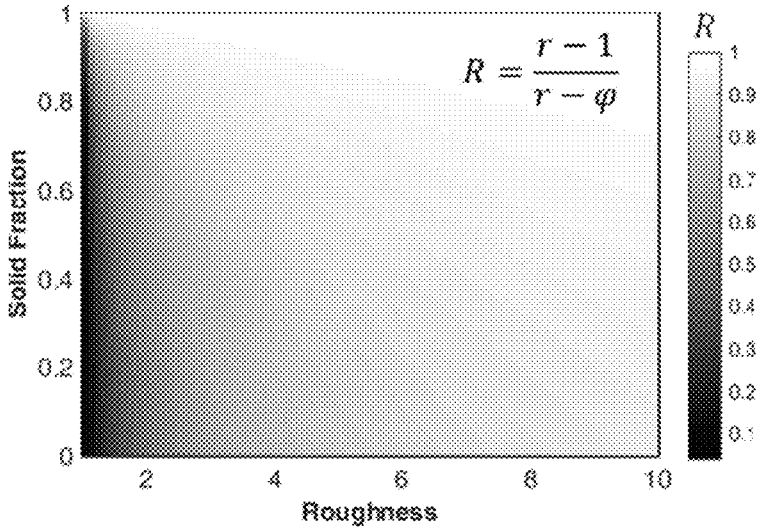
FIG. 6 depicts a plot of the geometric factor R. Values for R range from 0, corresponding to a flat surface, to 1, corresponding to a very rough surface.

The surface geometric factor R is determined by the roughness, r, which represents the actual solid surface area divided by the projected area, and the solid fraction, φ, which represents the fraction of the solid which contacts the base of the droplet. These properties are combined in the form R=(r−1)/(r−φ), where R can vary from 0 for a flat surface to 1 for an extremely rough surface, shown in FIG. 6. A higher value of R amplifies the interaction between the solid and either of the liquid phases compared to the liquid phases with each other or with the surrounding vapor. For instance, increasing R can satisfy criterion (III) for a given lubricant which does not spontaneously spread over a flat solid surface.

Effect of Tightening the Miscibility Constraint

Figure 7:
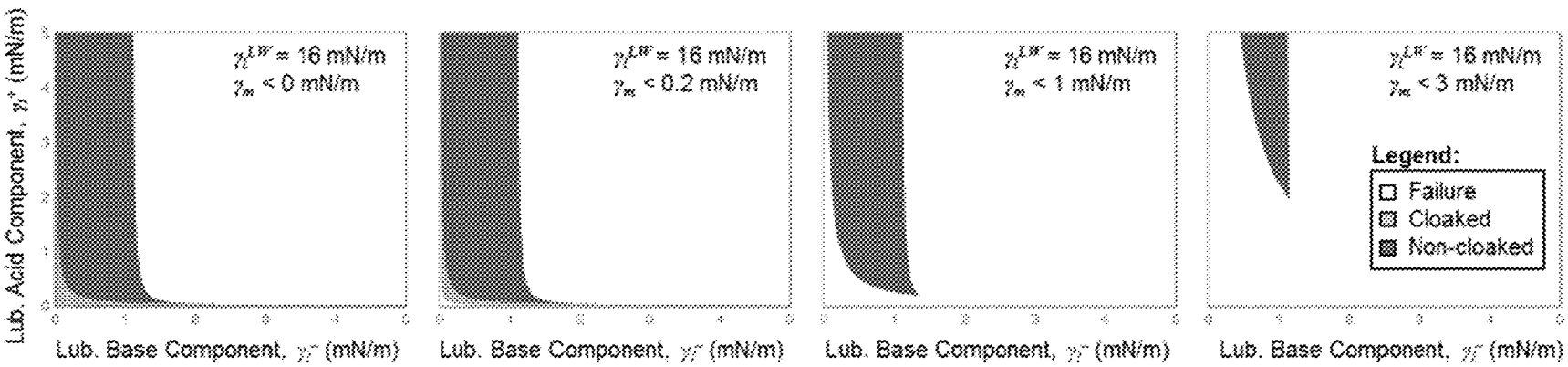
FIG. 7 depicts a result of changing the miscibility cutoff, $\gamma_m$. A higher miscibility cutoff results in a more conservative solution (i.e., more stringent requirement to be consider immiscible) which makes the solution domain smaller. Conversely, setting $\gamma_m$ to $-\infty$ is equivalent to removing criterion (V) from the model.

The miscibility criterion (V) in the manuscript can be more generally written as:

$$\gamma_{co}>\gamma_m \tag{15}$$

where $\gamma_m$ is a miscibility cutoff value. All predictions in this manuscript use a cutoff value of $\gamma_m$=0 mN/m unless otherwise indicated. The effect of altering the miscibility cutoff is explored here, with the result displayed in FIG. 7.

The optimal miscibility cutoff was calculated from a dataset comprised of 120 fluid-fluid interactions with known miscibility (binary values: either miscible or immiscible). See Reference 39. Only 20% of the cases in the dataset were for two immiscible fluids, with the remainder of the cases representing two miscible fluids. With this in mind, a successful prediction for two immiscible fluids was scored 4× higher than a successful prediction for two miscible fluids to avoid a bias in prediction capability towards miscible pairs, resulting in a maximum attainable score of 192 for the 120 cases corresponding to 100% prediction accuracy. The vOCG-based miscibility prediction (Equation 7 from the main text) was performed for all of the fluid pairs in the dataset, and the score based on the number of correct predictions was determined.

Figure 8:
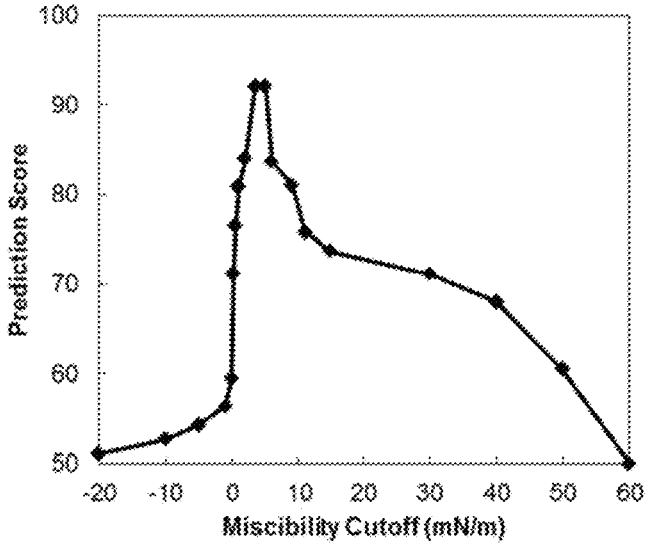
FIG. 8 depicts weighted miscibility prediction score versus miscibility cutoff value. The optimal value for accurate miscibility prediction is 3.5 mN/m, which could be used in criterion (V) instead of 0 mN/m for a more conservative prediction of whether a LIS surface will succeed.

The prediction score was bounded by 50% accuracy at a cutoff of −∞ when every prediction is immiscible (i.e., 50% agreement between the vOCG prediction and the dataset representing only the immiscible cases, 20% of the 120 cases scored with 4× weight for a total of 96 out of 192 points) and 50% accuracy at a cutoff of +∞ when every prediction is miscible (i.e., 50% agreement between the vOCG prediction and the dataset representing only the immiscible cases, 80% of the 120 cases scored with 1× weight for a total of 96 out of 192 points). The scores between these bounds are plotted in FIG. 8. The optimal cutoff for miscibility was found to be 3.5 mN/m based on this scoring algorithm, as it resulted in the highest likelihood of predicting either miscibility or immiscibility correctly. This cutoff will give a more conservative prediction of whether a proposed LIS will succeed or fail if used in criterion (V). In the main text, the miscibility cutoff value of $\gamma_m$=0 mN/m was used throughout to avoid the requirement for empirical data, but this more conservative "fitting parameter" miscibility cutoff value of $\gamma_m$=3.5 mN/m could be used to help eliminate spurious results in future work.

Choice of Solid Material for Polar Impinging Fluids

Figure 9:
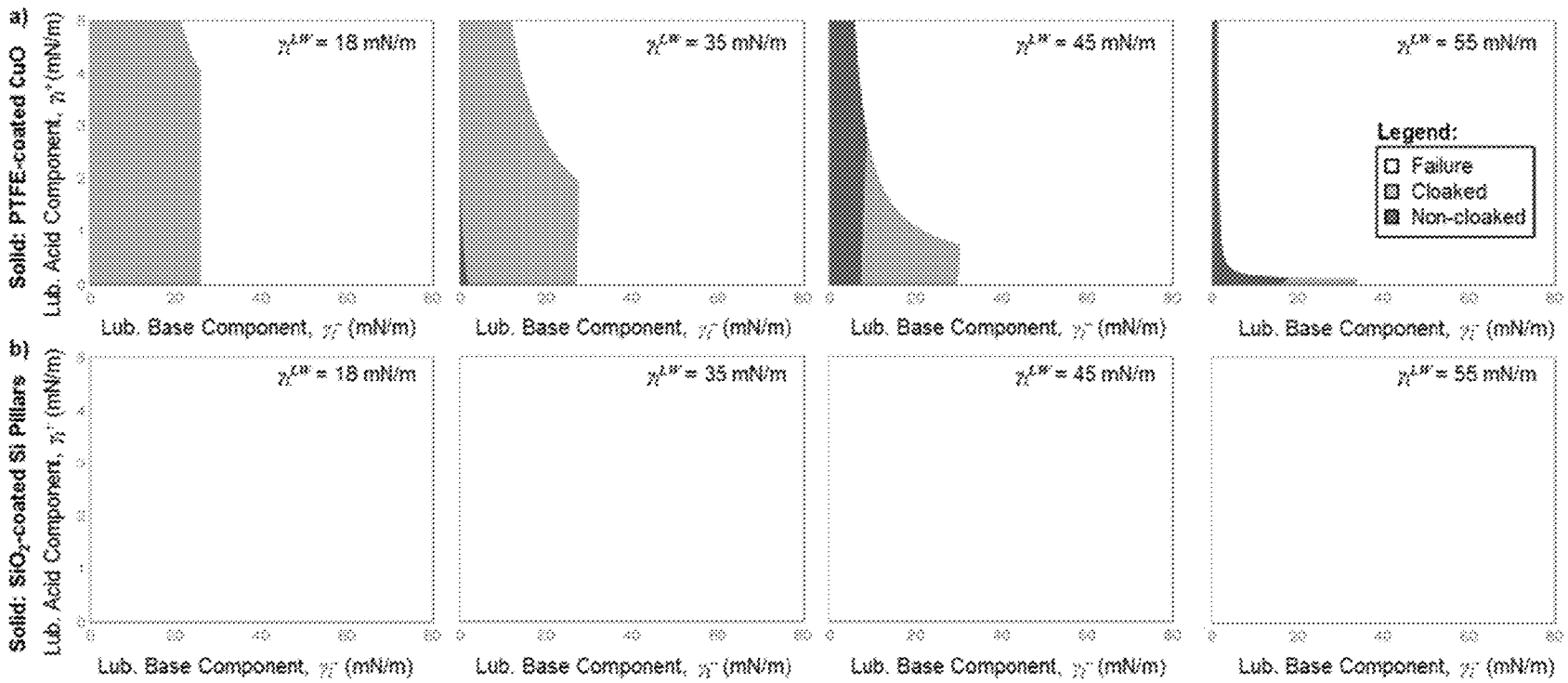
FIG. 9 depicts design of LIS to repel a polar fluid—in this case, water. The PTFE-coated solid surface allows a reasonable solution domain of fluid choices, shown in (panel A). The polar $SiO_2$ pillar array surface does not result in any solutions for practical lubricating fluids (solutions only exist for $\gamma^+$>20 mN/m, which is outside of the realm of available choices as illustrated in Table 3), shown in (panel B).

FIG. 2 demonstrated the suitability of polar surfaces with significant Lewis acid-base components of vOCG surface energy for repulsion of nonpolar impinging fluids. However, if the impinging fluid is very polar, a nonpolar solid surface will likely generate a larger solution domain as shown in FIG. 9 with water as the impinging fluid.

Results from Condensation Experiments

Figure 10:
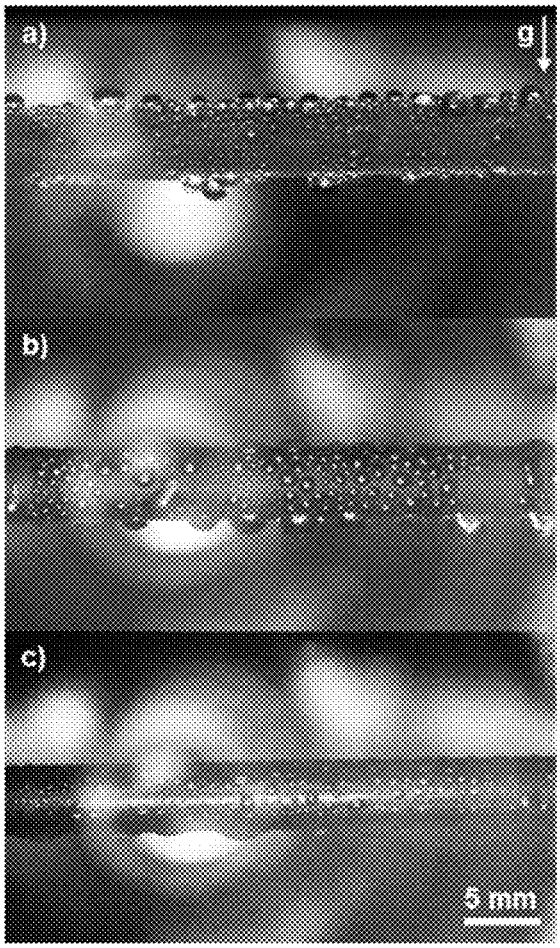
FIG. 10 depicts results from condensation of impinging fluids on LIS. Three different impinging fluids, (panel A) water, (panel B) toluene, and (panel C) pentane, were condensed onto a LIS comprised of Krytox GPL 101 infused into TFTS-coated CuO nanoblades. In all three cases, formation of discrete droplets of condensate was observed.

Images of several successful condensation tests performed with various fluids on a LIS are shown in FIG. 10. These results were used in Table 1 for the model validation.

Droplet Impingement Experimental Setup

Figure 11:
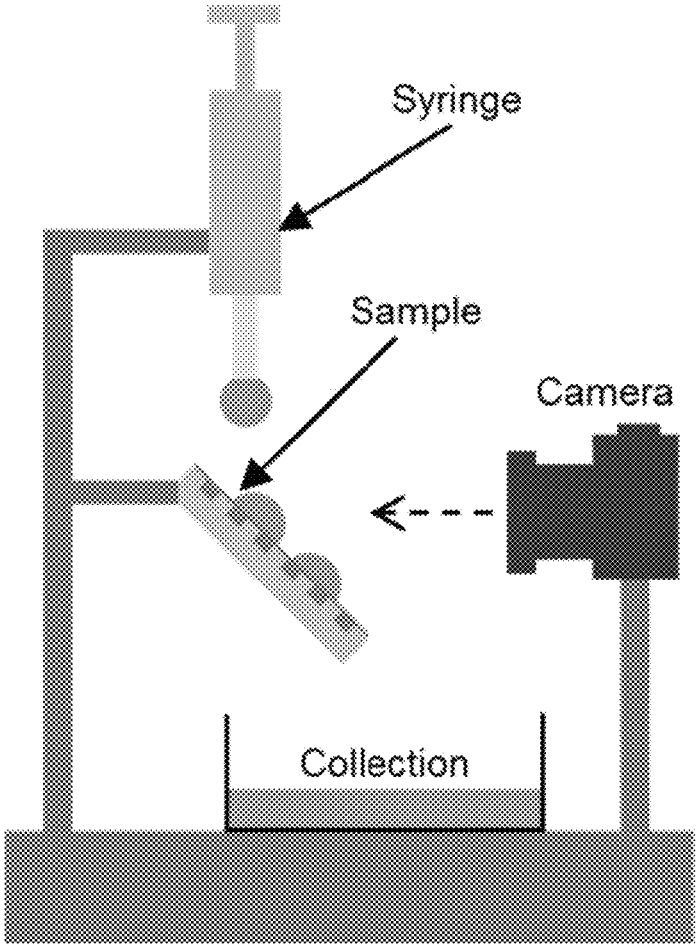
FIG. 11 depicts droplet impingement experimental setup. The droplets were dispensed from a syringe onto the sample, which was mounted at an angle beneath the syringe and in front of the camera. Departing impinging droplets fell into a collection vessel. The entire experimental setup was contained within a fume hood.

Experiments were performed for the LIS using $SiO_2$-coated pillar arrays fabricated on silicon wafers as the solid. The geometric factor of the pillar array used was R=0.71. Since these high-surface-energy $SiO_2$-coated pillars could not be applied to the exterior of the cylindrical condenser tubes, droplet impingement tests were performed to determine whether the proposed LIS designs were successful. The experimental setup is shown schematically in FIG. 11.

Reduction in Landau-Notation Order of Required Experiments

In terms of characterization of LIS from empirical measurements, certainly the direct measurement of interfacial energies, contact angles, spreading parameters, or other equivalent data to individually characterize each unique interface in a particular LIS system is reasonable for a relatively small set of phases, as has been performed in past work to describe experimentally observed LIS behaviour for sets of 1-2 solids, 1-3 lubricants, and <10 impinging fluids. However, as the number of possible solid, lubricant, and impinging fluid phases becomes large (as when exploring the full range of possible materials), direct interfacial characterization becomes intractable. Considering N total phases divided equally between solids, lubricants, and impinging fluids, the total number of surface energy components required to use the vOCG method to characterize every combination of fluids scales as O(N). Meanwhile, the number of unique interfaces formed between phases that would require experimental characterization scales as $O(N^3)$. To determine the behavior of each unique LIS combination for only 30 of each phase (30 solids, 30 lubricants, and 30 impinging fluids) would require 270 experimentally measured vOCG surface energy components for complete characterization with the model proposed in the present work. Conversely, if each unique interface were experimentally characterized as in past work, 27,000 experiments would need to be conducted, presumably requiring 100× more effort. Additionally, many commonly available phases have already had their vOCG surface energy components characterized; a table with vOCG surface energy components for over 150 phases is included in the Supporting Information above.

Effect of Gravity on Lubricant Drainage

Figure 12:
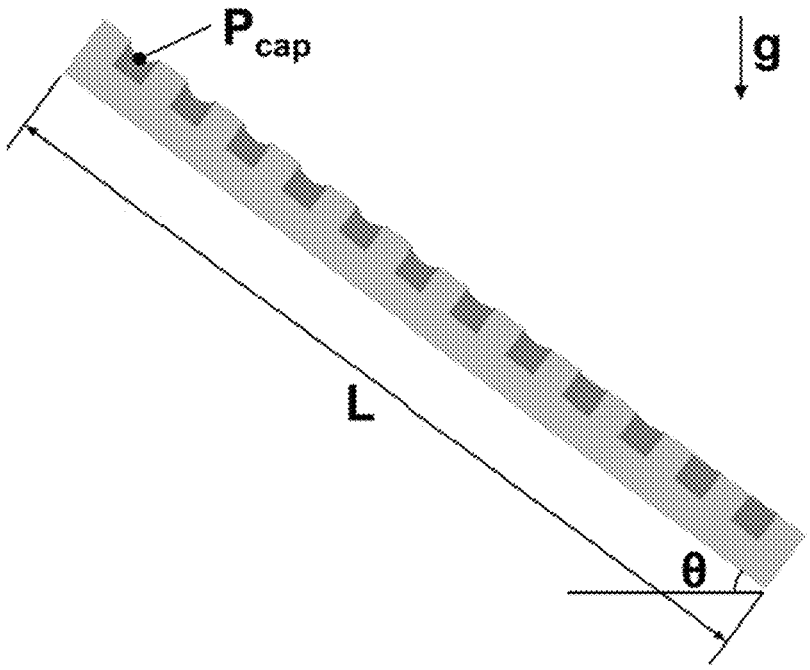
FIG. 12 depicts schematic illustrating contribution of gravity to LIS failure. The gravitational body force on the lubricant is counteracted by the Laplace pressure due to the curvature of the lubricant interface. If the maximum capillary pressure is not sufficient to support the gravitational body force, the lubricant will not cover the entire surface.

Gravity has the potential to partially deplete the lubricant from a LIS if the capillary pressure is not sufficient to hold the lubricant within the surface structures. For a tilted surface, illustrated schematically in FIG. 12, the capillary pressure can support the gravitational body force acting on the lubricant up to a maximum value, $P_{cap,max}$ based on the lubricant and surface chemistries and the surface structure geometry.

The maximum capillary pressure can be estimated from a commonly used method that considers the change in total surface energy as a given fluid volume propagates through a structured surface[40]:

$$P_{cap,max} = \frac{-\Delta E}{\Delta V} \tag{16}$$

where $-\Delta E$ is the change in surface energy and $\Delta V$ is the change in volume. For a structured surface comprised of a square array of pillars, Equation 16 simplifies to:

$$P_{cap,max} = \frac{\gamma_s - (\gamma_{ls} + \gamma_l) + \gamma_l R}{H(1-\varphi)} \tag{17}$$

where the numerator is simply the left-hand-side of Equation 5, for Criterion III, in the main text. Once the maximum capillary pressure is determined with Equation S4, the maximum surface length, $L_{max}$, that will remain stable in the presence of gravity is:

$$L_{max} = \frac{P_{cap,max}}{\rho g \sin(\theta)} \tag{18}$$

For example, taking the $SiO_2$ pillar array in the main text, with R=0.71 and φ=0.096, tilted at approximately 450 and with methanol as the lubricant, we find that the surface length at which gravitational lubricant depletion occurs is over 500 m, which is much larger than the sample length of 0.02 m used in the experiments in this work. Even the surface length required for gravitational lubricant depletion for diiodomethane (which has a lower attraction to $SiO_2$ and a higher density than methanol) as the lubricant is over 50 m, indicating that gravitational lubricant depletion did not play a role in the experiments in the present work.

This patent application covers lubricant infused surfaces, designed by the method and model presented in Preston, et al., 2018 (published in ACS Applied Materials and Interfaces), that do not require a chemical coating or treatment of the solid surface; rather, the lubricant can be directly applied to the solid surface to form a lubricant infused surface. Several potential use cases are presented below.

Based on this information and the model, additional configurations of materials can be tailored for particular conditions to create useful LIS structures without employing a low energy coating on a given substrate surface.

Metal Surfaces

Refrigeration and power cycles—particularly those employed in geothermal power stations and ultra-low temperature freezers—often use pentane and other low-surface-tension, nonpolar liquids as their internal working fluids. These cycles typically use metal condensers in which the working fluid is condensed from a vapor to a liquid, the efficiency of which can be improved by up to an order of magnitude when a lubricant infused surface is utilized on the condenser walls.

Based on the analytical model (described in detail above), a bare aluminum surface can be directly lubricated with commercially-available Krytox GPL 105 fluorinated lubricant, and the resulting lubricant infused surface can repel nonpolar liquids with surface tensions up to 15.9 mN/m, which encompasses working fluids like butane.

Similarly, a bare chromium surface lubricated with Krytox GPL 105 fluorinated lubricant can repel nonpolar liquids with surface tensions up to 16.05 mN/m; this range encompasses working fluids like pentane, and results in discrete droplets of the working fluid which easily depart from the surface, enhancing heat transfer during condensation.

Glass and Silicon Surfaces

A rough silicon wafer surface, lubricated with Krytox GPL 105 fluorinated lubricant, can repel nonpolar fluids with surface tensions up to 16.50 mN/m, resulting in mobile droplets that easily depart from the surface. This phenomenon may be of interest to commercial semiconductor manufacturers for fabrication-related purposes.

A rough silicon wafer surface may also be lubricated with water. In this case, the water-silicon lubricant infused surface will repel nonpolar fluids with surface tensions down to 22.5 mN/m, including nonane, decane, cyclohexane, benzene, tridecane, bromonapthalene, and diiodomethane.

Similarly, a rough glass surface may also be lubricated with water. In this case, the water-glass lubricant infused surface will repel nonpolar fluids with surface tensions down to 22.2 mN/m, which include paraffin wax, as well as the fluids nonane, decane, cyclohexane, benzene, tridecane, bromonapthalene, and diiodomethane. This water-glass lubricant infused surface will also repel (i.e., prevent adhesion of) solid particles, like particles comprised of oriented polypropylene, which may be of interest to the microfluidics and lab-on-a-chip communities.

Polymeric Surfaces

Polymeric surfaces that have a strong Lewis base component but weak Lewis acid component, like polydimethylsiloxane (PDMS) and polystyrene, can combine with lubricants that have a strong Lewis acid component but a weak Lewis base component, like chloroform, to repel a variety of impinging fluids. For example, PDMS and polystyrene, lubricated with chloroform, can repel nonpolar impinging fluids with surface tensions above 27.3 mN/m, like nonadecane, and can also repel some polar fluids, including water.

Fabrics

Lubricant infused fabrics can be produced in the same manner as lubricant infused solid surfaces, because the woven or knitted fabric provides a roughness into which the lubricant can infuse. For example, nylon fabric lubricated with hexafluoroisopropanol can repel nonpolar fluids with surface tensions ranging from 10.5 to 33.1 mN/m. Because hexafluoroisopropanol is nonflammable, this nylon-hexafluoroisopropanol lubricant infused fabric would be resistant to flaming aerosols or sprays of nonpolar, flammable liquids like butane, pentane, and hexane impinging on the fabric. Additionally, since criterion 1 (FIG. 1) is not met in this case, cloaking of impinging droplets would occur; the impinging, flaming droplets would be cloaked with hexafluoroisopropanol and subsequently extinguished.

REFERENCES

The following references are each incorporated by reference in its entirety.

(1) Kim, P.; Kreder, M. J.; Alvarenga, J.; Aizenberg, J. Hierarchical or Not? Effect of the Length Scale and Hierarchy of the Surface Roughness on Omniphobicity of Lubricant-Infused Substrates. *Nano Lett* 2013, 13 (4), 1793-1799.

(2) Wexler, J. S.; Jacobi, I.; Stone, H. A. Shear-Driven Failure of Liquid-Infused Surfaces. *Phys Rev Lett* 2015, 114 (16), 168301-168305.

(3) Irajizad, P.; Hasnain, M.; Farokhnia, N.; Sajadi, S. M.; Ghasemi, H. Magnetic slippery extreme icephobic surfaces. *Nat Commun* 2016, 7, 13395.

(4) Park, K. C.; Kim, P.; Grinthal, A.; He, N.; Fox, D.; Weaver, J. C.; Aizenberg, J. Condensation on slippery asymmetric bumps. *Nature* 2016, 531 (7592), 78-82.

(5) Epstein, A. K.; Wong, T. S.; Belisle, R. A.; Boggs, E. M.; Aizenberg, J. Liquid-infused structured surfaces with exceptional anti-biofouling performance. *P Natl Acad Sci USA* 2012, 109 (33), 13182-13187.

(6) Boreyko, J. B.; Polizos, G.; Datskos, P. G.; Sarles, S. A.; Collier, C. P. Air-stable droplet interface bilayers on oil-infused surfaces. *P Natl Acad Sci USA* 2014, 111 (21), 7588-7593.

(7) Vaaler, L. E. Impregnated porous condenser surfaces (U.S. Pat. No. 2,919,115). 1959.

(8) Verheijen, H. J. J.; Prins, M. W. J. Reversible electrowetting and trapping of charge: Model and experiments. *Langmuir* 1999, 15 (20), 6616-6620.

(9) Quere, D. Non-sticking drops. *Rep Prog Phys* 2005, 68 (11), 2495-2532.

(10) Lafuma, A.; Quere, D. Slippery pre-suffused surfaces. *Epi-Europhys Lett* 2011, 96 (5), 56001.

(11) Wong, T. S.; Kang, S. H.; Tang, S. K. Y.; Smythe, E. J.; Hatton, B. D.; Grinthal, A.; Aizenberg, J. Bioinspired self-repairing slippery surfaces with pressure-stable omniphobicity. *Nature* 2011, 477 (7365), 443-447.

(12) Xiao, R.; Miljkovic, N.; Enright, R.; Wang, E. N. Immersion Condensation on Oil-Infused Heterogeneous Surfaces for Enhanced Heat Transfer. *Sci Rep-Uk* 2013, 3, 1988.

(13) Miljkovic, N.; Xiao, R.; Preston, D. J.; Enright, R.; McKay, I.; Wang, E. N. Condensation on Hydrophilic, Hydrophobic, Nanostructured Superhydrophobic and Oil-Infused Surfaces. *J Heat Trans-T Asme* 2013, 135 (8), 080906.

(14) Cho, H. J.; Preston, D. J.; Zhu, Y.; Wang, E. N. Nanoengineering materials for liquid-vapour phase-change heat transfer. *Nature Materials Reviews* 2016, 2, 16092.

(15) Kim, P.; Wong, T. S.; Alvarenga, J.; Kreder, M. J.; Adorno-Martinez, W. E.; Aizenberg, J. Liquid-Infused Nanostructured Surfaces with Extreme Anti-Ice and Anti-Frost Performance. *Acs Nano* 2012, 6 (8), 6569-6577.

(16) Glavan, A. C.; Martinez, R. V.; Subramaniam, A. B.; Yoon, H. J.; Nunes, R. M. D.; Lange, H.; Thuo, M. M.; Whitesides, G. M. Omniphobic "R-F Paper" Produced by Silanization of Paper with Fluoroalkyltrichlorosilanes. *Adv Funct Mater* 2014, 24 (1), 60-70.

(17) Rykaczewski, K.; Paxson, A. T.; Staymates, M.; Walker, M. L.; Sun, X. D.; Anand, S.; Srinivasan, S.; McKinley, G. H.; Chinn, J.; Scott, J. H. J.; Varanasi, K. K. Dropwise condensation of low surface tension fluids on omniphobic surfaces. *Sci Rep-Uk* 2014, 4, 4158.

(18) Smith, D. J.; Dhiman, R.; Anand, S.; Reza-Garduno, E.; Cohen, R. E.; McKinley, G. H.; Varanasi, K. K. Droplet mobility on lubricant-impregnated surfaces. *Soft Matter* 2013, 9, 1772-1780.

(19) van Oss, C. J.; Chaudhury, M. K.; Good, R. J. Interfacial Lifshitz-Vanderwaals and Polar Interactions in Macroscopic Systems. *Chem Rev* 1988, 88 (6), 927-941.

(20) Preston, D. J.; Mafra, D. L.; Miljkovic, N.; Kong, J.; Wang, E. N. Scalable graphene coatings for enhanced condensation heat transfer. *Nano Lett* 2015, 15 (5), 2902-2909.

(21) Fowkes, F. M. Attractive Forces at Interfaces. *Ind Eng Chem* 1964, 56 (12), 40-52.

(22) Fowkes, F. M. Determination of Interfacial Tensions, Contact Angles, and Dispersion Forces in Surfaces by Assuming Additivity of Intermolecular Interactions in Surfaces. *J Phys Chem-Us* 1962, 66 (2), 382.

(23) Owens, D. K.; Wendt, R. C. Estimation of Surface Free Energy of Polymers. *J Appl Polym Sci* 1969, 13 (8), 1741-1747.

(24) van Oss, C. J.; Good, R. J. Prediction of the Solubility of Polar Polymers by Means of Interfacial-Tension Combining Rules. *Langmuir* 1992, 8 (12), 2877-2879.

(25) van Oss, C. J.; Good, R. J. On the Mechanism of Hydrophobic Interactions. *J Disper Sci Technol* 1988, 9 (4), 355-362.

(26) Aria, A. I.; Kidambi, P. R.; Weatherup, R. S.; Xiao, L.; Williams, J. A.; Hofinann, S. Time Evolution of the Wettability of Supported Graphene under Ambient Air Exposure. *J Phys Chem C* 2016, 120 (4), 2215-2224.

(27) Kontogeorgis, G. M.; Kiil, S. *Introduction to applied colloid and surface chemistry*, John Wiley & Sons: 2016.

(28) Janczuk, B.; Wojcik, W.; Zdziennicka, A. Determination of the Components of the Surface-Tension of Some Liquids from Interfacial Liquid-Liquid Tension Measurements. *J Colloid Interf Sci* 1993, 157 (2), 384-393.

(29) Della Volpe, C.; Siboni, S. Some reflections on acid-base solid surface free energy theories. *J Colloid Interf Sci* 1997, 195 (1), 121-136.

(30) Della Volpe, C.; Maniglio, D.; Brugnara, M.; Siboni, S.; Morra, M. The solid surface free energy calculation—I. In defense of the multicomponent approach. *J Colloid Interf Sci* 2004, 271 (2), 434-453.

(31) Della Volpe, C.; Siboni, S. Acid-base surface free energies of solids and the definition of scales in the Good-van Oss-Chaudhury theory. *Journal of Adhesion Science and Technology* 2000, 14 (2), 235-272.

(32) Fernandez, V.; Khayet, M. Evaluation of the surface free energy of plant surfaces: toward standardizing the procedure. *Front Plant Sci* 2015, 6, 510.

(33) Dalal, E. N. Calculation of Solid-Surface Tensions. *Langmuir* 1987, 3 (6), 1009-1015.

(34) Weng, M.; Shen, Q. Effect of liquid surface tension data on the validity and accuracy of solid surface tension components and parameters in the application of the van Oss-Chaudhury-Good approach. *Journal of Adhesion Science and Technology* 2014, 28 (22-23), 2248-2268.

(35) Kwok, D. Y. The usefulness of the Lifshitz-van der Waals/acid-base approach for surface tension components and interfacial tensions. *Colloid Surface A* 1999, 156 (1-3), 191-200.

(36) Lee, L. H. Relevance of film pressures to interfacial tension, miscibility of liquids, and Lewis acid-base approach. *J Colloid Interf Sci* 1999, 214 (1), 64-78.

(37) Lee, L. H. The gap between the measured and calculated liquid-liquid interfacial tensions derived from contact angles. *Journal of Adhesion Science and Technology* 2000, 14 (2), 167-185.

(38) Lee, L. H. The unified Lewis acid-base approach to adhesion and solvation at the liquid-polymer interface. *J Adhesion* 2001, 76 (2), 163-183.

(39) Restolho, J.; Mata, J. L.; Saramago, B. On the interfacial behavior of ionic liquids: Surface tensions and contact angles. *J Colloid Interf Sci* 2009, 340 (1), 82-86.

(40) Law, G.; Watson, P. R. Surface tension measurements of N-alkylimidazolium ionic liquids. *Langmuir* 2001, 17 (20), 6138-6141.

(41) Tariq, M.; Freire, M. G.; Saramago, B.; Coutinho, J. A. P.; Lopes, J. N. C.; Rebelo, L. P. N. Surface tension of ionic liquids and ionic liquid solutions. *Chem Soc Rev* 2012, 41 (2), 829-868.

(42) Anand, S.; Paxson, A. T.; Dhiman, R.; Smith, D. J.; Varanasi, K. K. Enhanced condensation on lubricant-impregnated nanotextured surfaces. *Acs Nano* 2012, 6 (11), 10122-10129.

(43) Clint, J. H. Adhesion and components of solid surface energies. *Curr Opin Colloid In* 2001, 6 (1), 28-33.

(44) van Oss, C. J.; Wu, W.; Docoslis, A.; Giese, R. F. The interfacial tensions with water and the Lewis acid-base surface tension parameters of polar organic liquids derived from their aqueous solubilities. *Colloid Surface B* 2001, 20 (1), 87-91.

(45) Boudenne, A.; Ibos, L.; Candau, Y.; Thomas, S. Handbook of Multiphase Polymer Systems, Vols 1-2. *Handbook of Multiphase Polymer Systems, Vols* 1-2 2011, 1-1010.

(46) Peterson, I. R. Towards a theory of adhesion with predictive power. *Surf Coat Int Pt B-C* 2005, 88 (1), 1-8.

(47) Chaudhury, M. K. Interfacial interaction between low-energy surfaces. *Mat Sci Eng R* 1996, 16 (3), 97-159.

(48) Xu, Z. H.; Liu, Q. X.; Ling, J. H. An Evaluation of the Van Oss-Chaudhury-Good Equation and Neumanns Equation of State Approach with Mercury Substrate. *Langmuir* 1995, 11 (3), 1044-1046.

(49) Gardner, D. J. Application of the Lifshitz-van der Waals acid-base approach to determine wood surface tension components. *Wood Fiber Sci* 1996, 28 (4), 422-428.

(50) Anand, S.; Rykaczewski, K.; Subramanyam, S. B.; Beysens, D.; Varanasi, K. K. How droplets nucleate and grow on liquids and liquid impregnated surfaces. *Soft Matter* 2015, 11 (1), 69-80.

(51) Thomas, R. R.; Kaufman, F. B.; Kirleis, J. T.; Belsky, R. A. Wettability of polished silicon oxide surfaces. *J Electrochem Soc* 1996, 143 (2), 643-648.

(52) Gould, G.; Irene, E. A. An Insitu Study of Aqueous Hf Treatment of Silicon by Contact-Angle Measurement and Ellipsometry. *J Electrochem Soc* 1988, 135 (6), 1535-1539.

(53) Aizenberg, J.; Aizenberg, M.; Kim, P. Slips Surface Based on Metal-Containing Compound (US Patent Application US20150175814 A1). 2015.

(54) Lee, C.; Kim, H.; Nam, Y. Drop Impact Dynamics on Oil-Infused Nanostructured Surfaces. *Langmuir* 2014, 30 (28), 8400-8407.

(55) Jung, S. M.; Preston, D. J.; Jung, H. Y.; Deng, Z. T.; Wang, E. N.; Kong, J. Porous Cu nanowire aerosponges from one-step assembly and their applications in heat dissipation. *Adv Mater* 2016, 28 (7), 1413-1419.

(56) Bhatia, B.; Preston, D. J.; Bierman, D. M.; Miljkovic, N.; Lenert, A.; Enright, R.; Nam, Y.; Lopez, K.; Dou, N.; Sack, J.; Chan, W. R.; Celanovic, I.; Soljacic, M.; Wang, E. N. Nanoengineered Surfaces for Thermal Energy Conversion. 15*th International Conference on Micro and Nanotechnology for Power Generation and Energy Conversion Applications* (*Powermems* 2015) 2015, 660, 012036.

(57) Preston, D. J.; Miljkovic, N.; Sack, J.; Enright, R.; Queeney, J.; Wang, E. N. Effect of hydrocarbon adsorption on the wettability of rare earth oxide ceramics. *Appl Phys Lett* 2014, 105, 011601.

(58) Daerr, A.; Mogne, A. Pendent_Drop: An ImageJ Plugin to Measure the Surface Tension from an Image of a Pendent Drop. *Journal of Open Research Software* 2016, 4 (1), e3.

(59) Nam, Y.; Ju, Y. S. Comparative Study of Copper Oxidation Schemes and Their Effects on Surface Wettability. *Imece* 2008*: Heat Transfer, Fluid Flows, and Thermal Systems*, Vol 10, Pts a-C 2009, 1833-1838.

(60) Preston, D. J.; Anders, A.; Barabadi, B.; Tio, E.; Zhu, Y.; Dai, D. A.; Wang, E. N. Electrowetting-on-dielectric actuation of a vertical translation and angular manipulation stage. *Appl Phys Lett* 2016, 109 (24), 244102.

(61) Preston, D. J.; Anders, A.; Barabadi, B.; Tio, E.; Zhu, Y.; Dai, D. A.; Wang, E. N., Electrowetting-on-dielectric actuation of a spatial and angular manipulation MEMS stage. In 2017 *IEEE 30th International Conference on Micro Electro Mechanical Systems* (*MEMS*), IEEE: Las Vegas, 2017; pp 769-772.

(62) Preston, D. J.; Miljkovic, N.; Enright, R.; Wang, E. N. Jumping droplet electrostatic charging and effect on vapor drag. *Journal of Heat Transfer* 2014, 136 (8), 080909.

SUPPORTING INFORMATION REFERENCES

The following references are each incorporated by reference in its entirety. (SI References)

1 van Oss, C. J. & Good, R. J. Prediction of the Solubility of Polar Polymers by Means of Interfacial-Tension Combining Rules. *Langmuir* 8, (1992).

2 Etzler, F. M. Determination of the Surface Free Energy of Solids. *Rev. Adhesion Adhesives* 1, (2013).

3 *Surface Tension Components and Molecular Weight of Selected Liquids*, <https://www.accudynetest.com/surface_tension_table.html> (2017).

4 Wu, S. *Polymer interface and adhesion*. (M. Dekker, 1982).

5 Carre, A. Polar interactions at liquid/polymer interfaces. *Journal of Adhesion Science and Technology* 21, (2007).

6 Mittal, K. L. *Contact angle, wettability and adhesion*. (VSP, 2009).

7 Binks, B. P. & Clint, J. H. Solid wettability from surface energy components: Relevance to pickering emulsions. *Langmuir* 18, (2002).

8 Rykaczewski, K., Paxson, A. T., Staymates, M., Walker, M. L., Sun, X. D., Anand, S., Srinivasan, S., McKinley, G. H., Chinn, J., Scott, J. H. J. & Varanasi, K. K. Dropwise condensation of low surface tension fluids on omniphobic surfaces. *Scientific Reports* 4, (2014).

9 Liu, T. Y. & Kim, C. J. Turning a surface superrepellent even to completely wetting liquids. *Science* 346, (2014).

10 Chan, D., Hozbor, M. A., Bayramli, E. & Powell, R. L. Surface Characterization of Intermediate Modulus Graphite Fibers Via Surface Free-Energy Measurement and Esca. *Carbon* 29, (1991).

11 Kwok, D. Y., Li, D. & Neumann, A. W. Evaluation of the Lifshitz Van-Der-Waals Acid-Base Approach to Determine Interfacial-Tensions. *Langmuir* 10, (1994).

12 Wang, H. & Newby, B. M. Z. Applicability of the extended Derjaguin-Landau-Verwey-Overbeek theory on the adsorption of bovine serum albumin on solid surfaces. *Biointerphases* 9, (2014).

13 Lee, L.-H. *Fundamentals of adhesion*. (Plenum Press, 1991).

14 McCafferty, E. & Wightman, J. P. Determination of the acid base properties of metal oxide films and of polymers by contact angle measurements. *Apparent and Microscopic Contact Angles*, (2000).

15 Bouali, B., Ganachaud, F., Chapel, J. P., Pichot, C. & Lanteri, P. Acid-base approach to latex particles containing specific groups based on wettability measurements. *Journal of Colloid and Interface Science* 208, (1998).

16 van Oss, C. J., Giese, R. F. & Good, R. J. Reevaluation of the Surface-Tension Components and Parameters of Polyacetylene from Contact Angles of Liquids. *Langmuir* 6, (1990).

17 Good, R. J., Islam, M., Baier, R. E. & Meyer, A. E. The effect of surface hydrogen bonding (acid-base interaction) on the hydrophobicity and hydrophilicity of copolymers: Variation of contact angles and cell adhesion and growth with composition. *Journal of Dispersion Science and Technology* 19, (1998).

18 Azioune, A., Chehimi, M. M., Miksa, B., Basinska, T. & Slomkowski, S. Hydrophobic protein-polypyrrole interactions: The role of van der Waals and Lewis acid-base forces as determined by contact angle measurements. *Langmuir* 18, (2002).

19 Fadda, E. & Clarisse, C. Characterization of the Surface Modifications of Conducting Poly(3-Octylthiophene) Films by Contact-Angle Measurements. *Synthetic Metals* 72, (1995).

20 Bodino, F. Ph.D. thesis, Faculte's Universitaires Notre-Dame de la Paix, (1998).

21 van Oss, C. J., Chaudhury, M. K. & Good, R. J. The Mechanism of Phase-Separation of Polymers in Organic Media—Apolar and Polar Systems. *Separation Science and Technology* 24, (1989).

22 Jacobasch, H. J., Grundke, K., Schneider, S. & Simon, F. Surface Characterization of Polymers by Physico-Chemical Measurements. *The Journal of Adhesion* 48, (1995).

23 Chibowski, E. & Gonzalezcaballero, F. Interpretation of Contact-Angle Hysteresis. *Journal of Adhesion Science and Technology* 7, (1993).

24 van Oss, C. J., Good, R. J. & Busscher, H. J. Estimation of the Polar Surface-Tension Parameters of Glycerol and Formamide, for Use in Contact-Angle Measurements on Polar Solids. *Journal of Dispersion Science and Technology* 11, (1990).

25 van Oss, C. J. & Good, R. J. Surface Tension and the Solubility of Polymers and Biopolymers: The Role of Polar and Apolar Interfacial Free Energies. *Journal of Macromolecular Science: Part A—Chemistry* 26, (1989).

26 Janczuk, B., Chibowski, E., Bruque, J. M., Kerkeb, M. L. & Caballero, F. G. On the Consistency of Surface Free-Energy Components as Calculated from Contact Angles of Different Liquids—an Application to the Cholesterol Surface. *Journal of Colloid and Interface Science* 159, (1993).

27 Hollander, A. On the Selection of Test Liquids for the Evaluation of Acid-Base Properties of Solid-Surfaces by Contact-Angle Goniometry. *Journal of Colloid and Interface Science* 169, (1995).

28 van Oss, C. J. *Interfacial forces in aqueous media*. (M. Dekker, 1994).

29 van Oss, C. J., Chaudhury, M. K. & Good, R. J. Monopolar Surfaces. *Advances in Colloid and Interface Science* 28, (1987).

30 Good, R. J., Shu, L. K., Chiu, H. C. & Yeung, C. K. Hydrogen bonding and the interfacial component of adhesion: Acid/base interactions of corona-treated polypropylene. *Journal of Adhesion* 59, (1996).

31 Freitas, A. M. & Sharma, M. M. Effect of surface hydrophobicity on the hydrodynamic detachment of particles from surfaces. *Langmuir* 15, (1999).

32 van Oss, C. J. *Forces Interfaciales En Milieux Aqueux*. (1996).

33 Millsap, K. W., Bos, R., Busscher, H. J. & van der Mei, H. C. Surface Aggregation of *Candida* albicanson Glass in the Absence and Presence of Adhering *Streptococcus gordonii* in a Parallel-Plate Flow Chamber: A Surface Thermodynamical Analysis Based on Acid-Base Interactions. *Journal of Colloid and Interface Science* 212, (1999).

34 Bos, R. & Busscher, H. J. Role of acid-base interactions on the adhesion of oral streptococci and *actinomyces* to hexadecane and chloroform—influence of divalent cations and comparison between free energies of partitioning and free energies obtained by extended DLVO analysis. *Colloids and Surfaces B-Biointerfaces* 14, (1999).

35 Janczuk, B., Bialopiotrowicz, T. & Zdziennicka, A. Some remarks on the components of the liquid surface free energy. *Journal of Colloid and Interface Science* 211, (1999).

36 Present Work.

37 Smith, J. D. *Hydrate-phobic surfaces*, Massachusetts Institute of Technology, (2011).

38 Chen, J. K., Ko, F. H., Hsieh, K. F., Chou, C. T. & Chang, F. C. Effect of fluoroalkyl substituents on the reactions of alkylchlorosilanes with mold surfaces for nanoimprint lithography. *Journal of Vacuum Science & Technology B* 22, (2004).

39 Phenomenex_Publications. A User's Guide to Gel Permeation Chromatography. (2000).

40 Xiao, R., Enright, R. & Wang, E. N. Prediction and Optimization of Liquid Propagation in Micropillar Arrays. *Langmuir* 26, (2010).

Other embodiments are within the scope of the following claims.

What is claimed is:

1. A method of preparing a lubricant infused surface for droplet formation comprising:

providing a solid surface;

selecting a lubricant; and exposing the solid surface to the selected lubricant by directly applying to the solid surface to form the lubricant infused surface without applying a low-surface-energy coating to the surface, wherein the lubricant infused surface repels fluids with a surface tension of less than 17 mN/m.

2. The method of claim 1, wherein the surface is a high-surface-energy structured solid having a surface energy between 35 and 55 mN/m.

3. The method of claim 1, wherein a portion of the surface includes a polar lubricant.

4. The method of claim 1, wherein a surface energy of the lubricant does not match a surface energy of the solid surface.

5. The method of claim 1, wherein the lubricant infused surface repels fluids with a surface tension of less than 15 mN/m.

6. A method of droplet formation comprising:

exposing a lubricant infused surface to a vapor, and wherein the lubricant infused surface is formed by directly applying the lubricant to a solid surface without applying a low-surface-energy coating to the solid surface, wherein the lubricant infused surface repels fluids with a surface tension of less than 17 mN/m.

7. The method of claim 6, wherein the surface is a high-surface-energy structured solid having a surface energy between 35 and 55 mN/m.

8. The method of claim 6, wherein a portion of the surface includes a polar lubricant.

9. The method of claim 6, wherein a surface energy of the lubricant does not match a surface energy of the solid surface.

10. The method of claim 6, wherein the lubricant infused surface repels fluids with a surface tension of less than 15 mN/m.

11. A lubricant infused surface comprising:

a surface and a lubricant infused into the surface, the lubricant infused surface having the lubricant directly on the surface, wherein the lubricant infused surface repels fluids with a surface tension of less than 17 mN/m.

12. The lubricant infused surface of claim 11, wherein the surface is a high-surface-energy structured solid having a surface energy between 35 and 55 mN/m.

13. The lubricant infused surface of claim 11, wherein the lubricant infused surface repels fluids with a surface tension of less than 15 mN/m.

* * * * *